US005861586A

United States Patent [19]

McCarthy et al.

[11] Patent Number: 5,861,586

[45] Date of Patent: Jan. 19, 1999

[54] HORIZONTAL AND VERTICAL PASSENGER TRANSPORT

[75] Inventors: Richard C. McCarthy, Simsbury; Joseph Bittar, Avon; Frederick H. Barker, Bristol; Bruce A. Powell, Canton; Samuel C. Wan, Simsbury; Paul Bennett, Waterbury; Anthony Cooney, Unionville; John K. Salmon, deceased, late of South Windsor, all of Conn., by LucyMary Salmon, legal representative

[73] Assignee: Otis Elevator Company, Farmington, Conn.

[21] Appl. No.: 749,296

[22] Filed: Nov. 14, 1996

Related U.S. Application Data

[63] Continuation-in-part of Ser. No. 666,162, Jun. 19, 1996, Pat. No. 5,773,772.

[51] Int. Cl.[6] ..... B66B 9/00; B66B 1/06

[52] U.S. Cl. ..... 187/289; 187/249; 414/592

[58] Field of Search ..... 187/289, 401, 187/249, 402, 414; 414/609, 610, 592

[56] References Cited

U.S. PATENT DOCUMENTS

| | | | |
|---|---|---|---|
| 1,939,729 | 12/1933 | Stark | 187/249 |
| 5,064,331 | 11/1991 | Yamaguchi et al. | 414/344 |
| 5,090,515 | 2/1992 | Takahashi et al. | 187/249 |
| 5,651,426 | 7/1997 | Bittar et al. | 187/249 |
| 5,655,625 | 8/1997 | Barker et al. | 187/249 |
| 5,749,441 | 5/1998 | Bittar et al. | 187/249 |
| 5,752,585 | 5/1998 | Bittar et al. | 187/249 |
| 5,758,748 | 6/1998 | Barker et al. | 187/249 |
| 5,773,772 | 6/1998 | McCarthy et al. | 187/289 |

FOREIGN PATENT DOCUMENTS

| | | |
|---|---|---|
| 0388814A2 | 3/1990 | European Pat. Off. . |
| 2618237A1 | 11/1977 | Germany . |
| 4-153187 | 5/1992 | Japan . |
| 04361977 | 12/1992 | Japan . |
| 06156939 | 6/1994 | Japan . |

OTHER PUBLICATIONS

European Search Report.

*Primary Examiner*—Robert E. Nappi

[57] ABSTRACT

Elevator cabs are transferred between elevators, which may be shuttles, in various levels of a building, such as transport floors, in response to car calls registered in the cabs and hall calls registered on the transport floors. The cabs may be transferred from carriages or bogeys onto elevator car frames in a lateral direction, which is perpendicular to the motion of the cab on a carriage or bogey, or in a longitudinal direction which is the same as the direction of motion of a cab on a carriage or bogey. The horizontal/vertical control and transfer may be effected in response to the arrival at transport floors of elevators having cabs therein, or in response to the arrival at an elevator of a bogey carrying a cab which must be transported between a transport floor on one level of a building and a transport floor on another level of a building, in order to serve the need of a car call registered therein or a hall call. The horizontal transportation may occur on transport floors within a building, or may extend between different building segments or between different buildings.

31 Claims, 19 Drawing Sheets

HORIZONTAL AND VERTICAL PASSENGER TRANSPORT

This application is a continuation-in-part of parent application U.S. Ser. No. 08/666,162 filed on Jun. 19, 1996 now U.S. Pat. No. 5,773,772.

TECHNICAL FIELD

This invention relates to moving passengers vertically, as in elevators, as well as horizontally, as in cabs on carriages or bogeys, and relationships therebetween.

BACKGROUND ART

In hypertall buildings (those having many more than 100 floors), the problem of the limited practical length of elevator hoistways has been solved in part by means of coupling of hoistways together, and transferring an elevator cab therebetween, as disclosed in commonly owned copending U.S. application Ser. No. 08/564,754, filed on Nov. 29, 1995. In addition, the number of elevators required to move an adequate number of passengers between floors which are separated significantly (near the bottom of the building and near the top of the building) is increased by the extent to which passengers, in unloading and reloading the elevator, cause the elevator cabs to remain at rest, rather than moving passengers. This problem has been overcome to a great extent by means of offshaft loading of elevator cabs, as is disclosed in commonly owned copending U.S. patent application 08/565,606, filed Nov. 29, 1995. However, when local elevators are involved (rather than shuttles between widely diverse floors), the movement of the elevator is slowed by the number of stops, and by extent to which passengers delay the unloading and loading thereof. To improve transportation between floors near a low end of the building and floors separated a great distance from the lobby, the automatic transfer of elevator cabs between shuttles which may move the passengers hundreds of floors, and local elevators which deliver them to their destinations, has been accomplished as illustrated in the parent application hereto and in commonly owned copending U.S. patent application Ser. No. 08/663,869, filed on Jun. 19, 1996.

As is true in the case of moving passengers great vertical distances in hypertall buildings, the movement of passengers between horizontal transportation (such as mass transit and the like) and vertical transportation (such as elevators), is aggravated by the interface between the transportation modes due to the unpredictability of passenger movement when passengers are milling around on foot.

DISCLOSURE OF INVENTION

Objects of the invention include provision of integrated passenger transportation in both horizontal and vertical directions; horizontal transportation of passengers on floors of very large buildings which is integrated with vertical transportation of passengers above and below such floors; and integrated transportation between diverse buildings or building segments separated by significant horizontal distance, in which vertical transportation is provided in the diverse buildings or segments.

According to the present invention, passenger cabs are transferred between elevator car frames and horizontally moving bogeys or carriages to provide integrated vertical and horizontal transportation for passengers. In accordance with the invention further, transportation of passengers is effected by moving an elevator cab from a given elevator car frame onto a selected one of a plurality of horizontally moveable carriages or bogeys. In further accord with the invention, integrated horizontal and vertical transportation is provided by transferring a passenger cab from a horizontally moving carriage or bogey on one floor level into a selected one of a plurality of shuttle elevator shafts for movement to another floor level. In still further accord with the present invention, a passenger cab can be transferred from an elevator to either a floor level for horizontal transportation to selected stops, or into another elevator for transfer to yet another floor level, in dependence upon the car calls established in the passenger cab.

As used herein, the term "horizontally remote" means separated by a distance for which it is advantageous for normal persons to ride in a vehicle as opposed to walking, in satisfying a need or desire to get from one place to another place.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
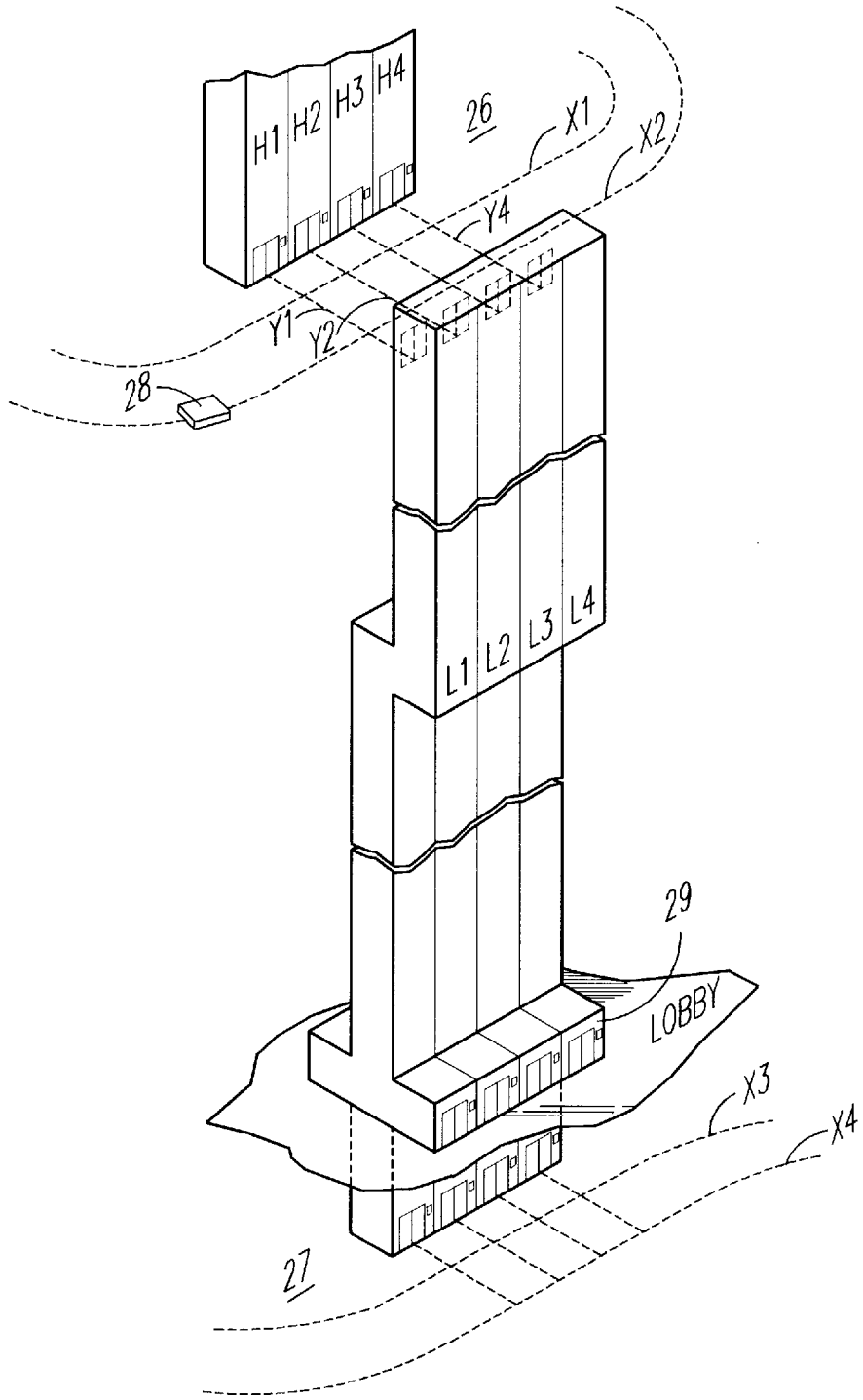
FIG. 1 is a simplified, stylized, perspective view of elevator shuttles in a hypertall building interconnecting with horizontal transports on a plurality of transport floors.

Referring now to FIG. 1, the horizontal and vertical transportation of passengers in accordance with an embodiment of the present invention includes transferring passenger cabs at a transport floor 26 between a first group of vertical elevator shuttles L1–L4, a second group of elevators H1–H4, which may be shuttles or local elevators, and carriages such as a carriage 28, which are moveable on horizontal tracks X1, X2. Switching between the elevators and the tracks X1, X2 is accomplished in part by moving of carriages on tracks Y1–Y4, which are transverse to the tracks X1 and X2. The tracks Y1–Y4 provide the capability to move a cab from any one of the elevators L1–L4 to either of the tracks X1–X2 or to any of the elevators H1–H4, and vice versa. In accordance with one aspect of the present invention, the transport floor 26 may comprise an upper floor of a hyper building. On the other hand, the invention about to be described may also be practiced with horizontal transportation on tracks X3, X4 extending on or near a ground level, such as may occur in or under a downtown underground mall of a common variety, on a transport floor 27. The cabs may be removed from the elevators at landings 29 at the lobby level, for unloading and loading, as in said application Ser. No. 08/565,606.

Figure 2:
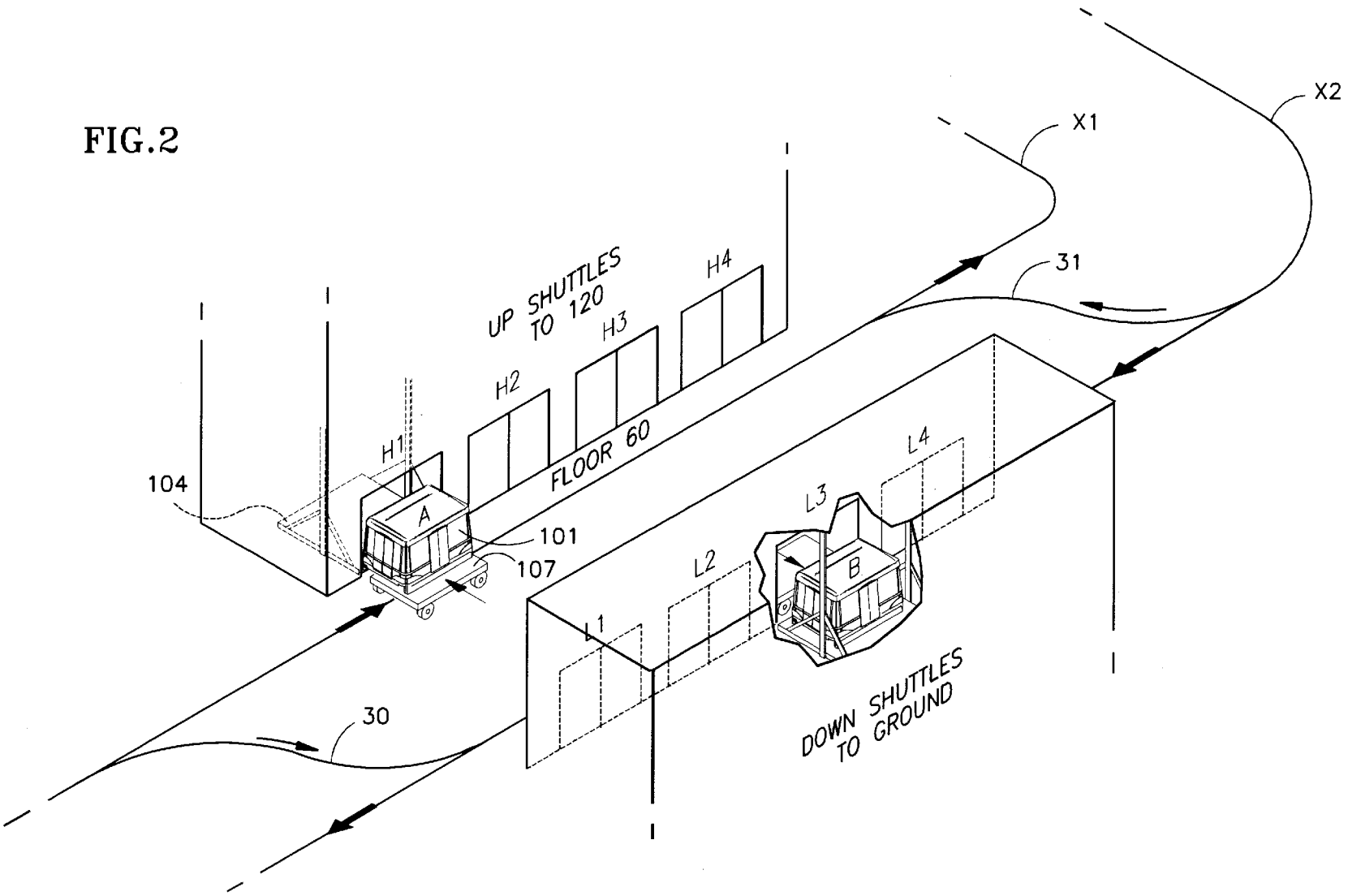
FIG. 2 is a partial, simplified perspective view, partially broken away, showing additional detail at a transport floor of FIG. 1.

The concept is further illustrated in FIG. 2 wherein a cab A 101 is shown being loaded onto an elevator H1 at, for instance, the 60th floor of a building, for transport, for instance, to the 120th floor of the building. Similarly, a cab B is being shown loaded onto an elevator shuttle L3 for vertical transportation to the ground level of the building. As shown in FIG. 2, the tracks X1, X2 may be connected by crossovers 30, 31 which themselves will comprise tracks of the same variety as the tracks X1, X2 and Y1–Y4 of FIG. 1. The tracks Y1–Y4 are omitted from FIG. 2 for simplicity. As one example of an embodiment of the present invention, the carriage 107 and mechanism for transferring the cab 101 between the carriage 107 and the car frame platform 104 of the parent application are illustrated in FIGS. 3–6.

Figure 3:
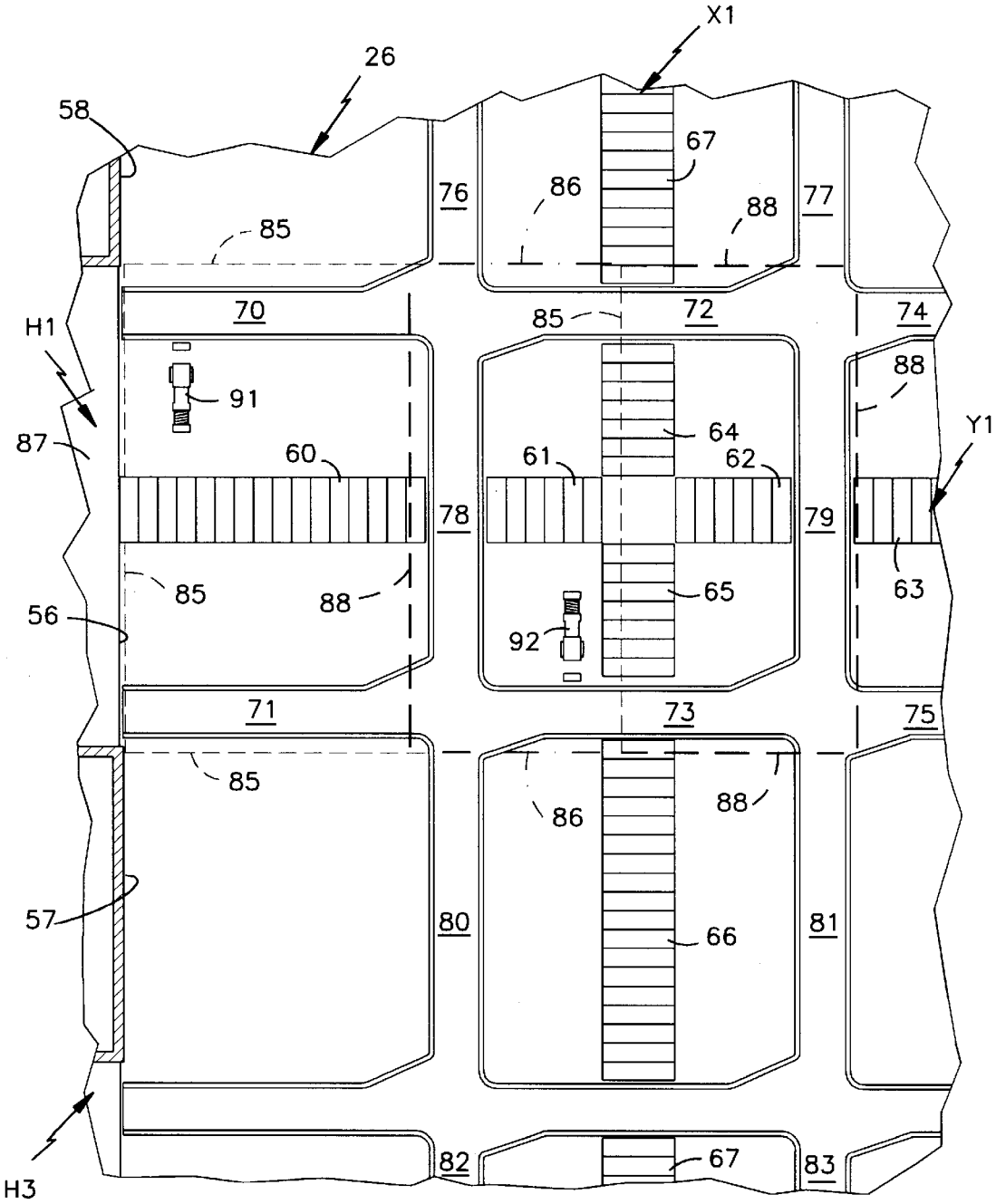
FIG. 3 is a partial, stylized top plan view of a transport floor of the system of FIG. 1.

Referring now to FIG. 3, a fragment of the transfer floor 26 is shown at the intersection of path X1 with path Y1, adjacent the hatchway 56 of high elevator H4, between walls 57, 58 which separate the hatchways. In the present invention, each of the paths on the transfer floor X1, X2, Y1–Y4 includes segments of linear induction motor (LIM) primaries 60–67 and pairs of wheel track segments such as, along the path Y4, track segments 70–75 and along the X1 path, track segments 76–83. In FIG. 3, the dotted lines 85 together with the dot dash lines 86 describe the outline of the cab carrier 107 in accordance with the invention when it is positioned adjacent to the high elevator H1, butted up against the sill 87 of the hatchway 56 between inter-elevator wall structures 57, 58. The dash lines 88 together with the dot dash lines 86 describe the outline of the carrier 107 when it has moved away from the local elevator L1 to a position centered on the path X1 so that it may travel in the X direction. For clarity, the illustration of FIG. 3 is not drawn to scale. However, it is clear that, if desired, the X path could be closer to the elevators, such as elevator H1, causing the tracks 70, 71 and the segment 60 to be shorter than shown. However, it is believed best to have some length of LIM primary 60 to assure adequate acceleration power for movement of the carriage with a cab on it. The configuration details are irrelevant to the invention and may be selected to suit any implementation thereof.

In this embodiment, carriage/floor locks 91, 92 are disposed in diagonally opposite quadrants within the area where a carriage will come to rest. These may be the same as the cab/car locks disclosed in commonly owned U.S. patent application Ser. No. 08/565,658 filed on Nov. 29, 1995, and described more hereinafter.

Figure 4:
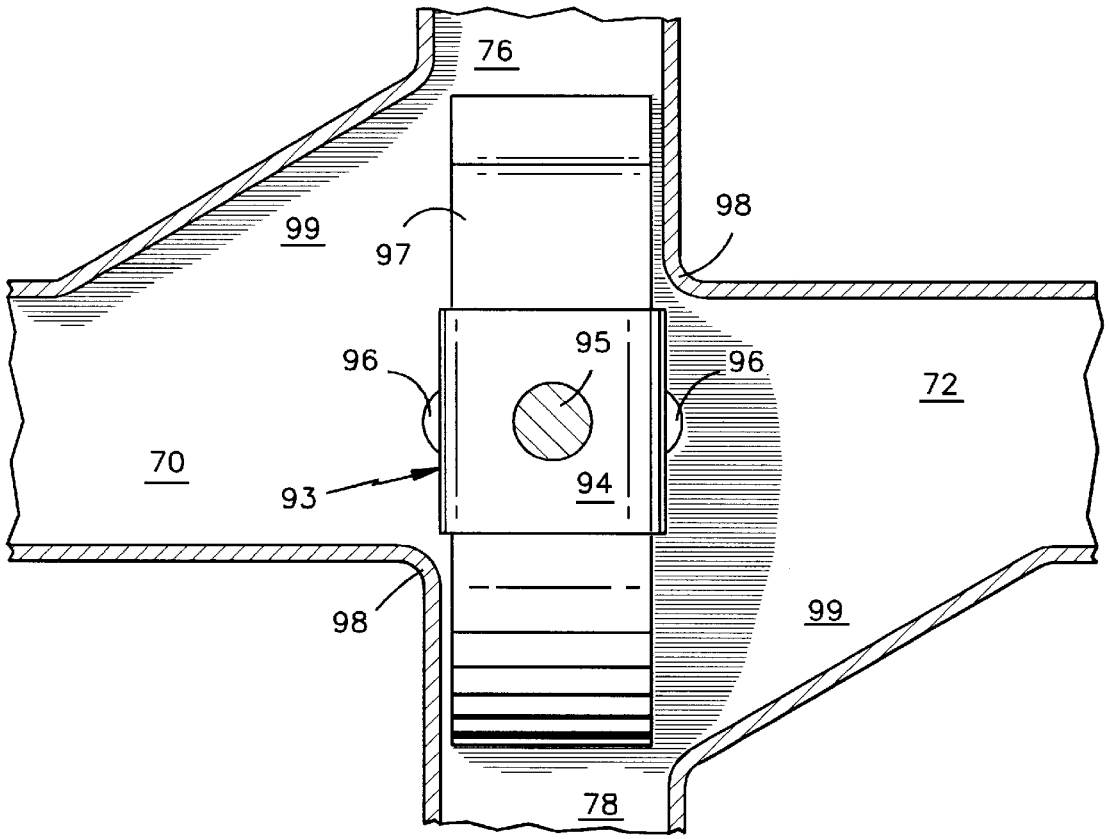
FIG. 4 is a detailed, partial, partially sectioned top plan view of the transport floor of FIG. 3 illustrating a caster of a cab carrier at a track intersection.

In FIG. 4, a wheel track intersection between tracks 70, 72, 76 and 78 is shown. A caster 93 includes a bracket 94 that joins a pivot 95 to a spindle 96 which constrains the bearings (not shown) of a wheel 97. The intersection is formed to assure motion: should the carriage first be moved along an X path, so that the caster 93 is in the position shown in FIG. 4, and next be required to move along a Y path, the combination of abutments 98 and open areas 99 in each intersection ensure that the caster can move in the Y direction, either along the track 70 or along the track 72. It should be borne in mind that the distances involved on the transfer floor are small (tens of meters overall), and the carriage speed is most likely preferably quite slow so that horizontal movement will not jar the passengers unduly. Under these conditions, passive steering of a caster can be acceptable. However, more complex steering may be provided within the purview of the invention.

Figure 5:
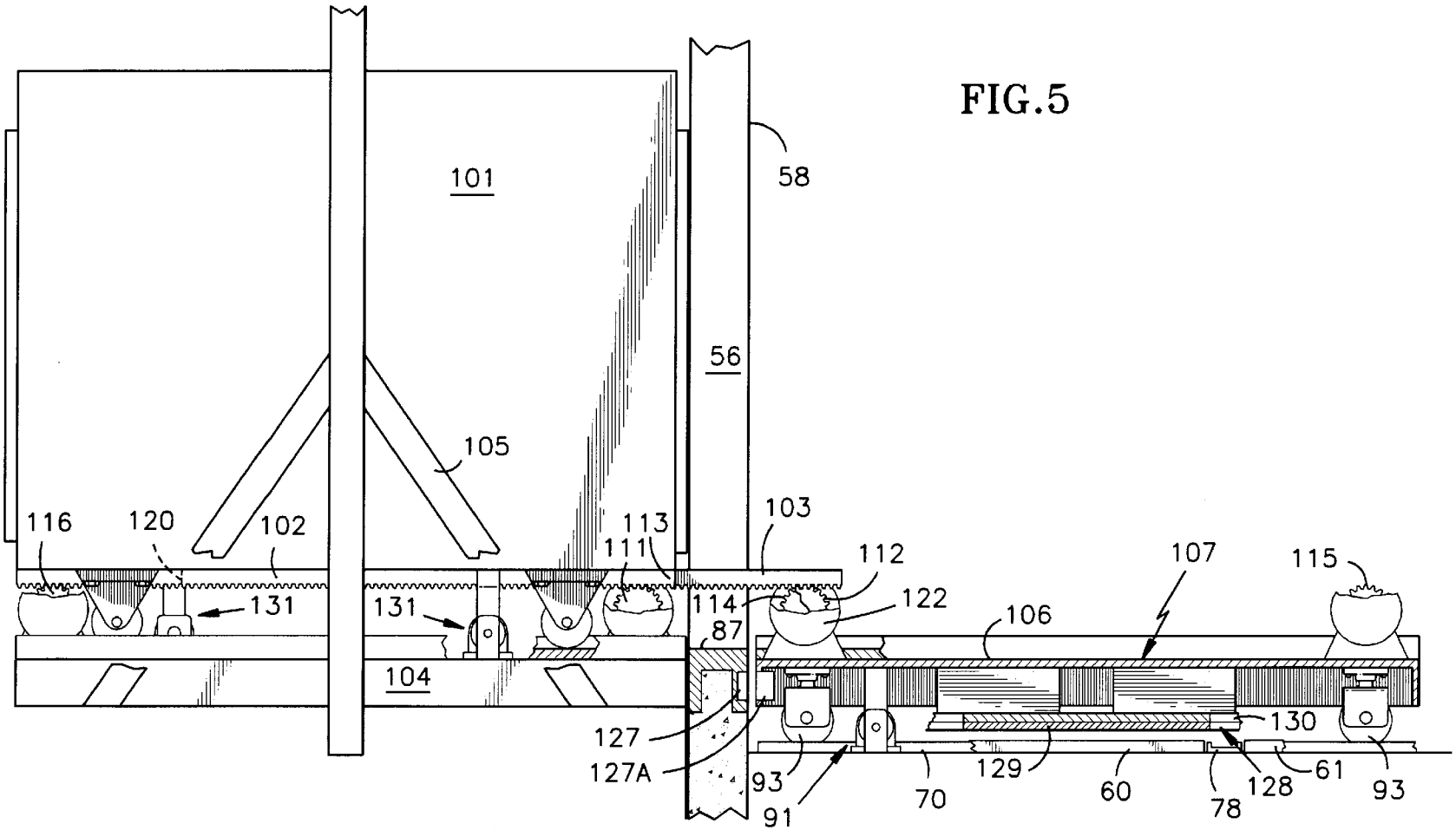
FIG. 5 is a partial, stylized, partially broken away, partially sectioned side elevation view of an elevator cab in the process of being transferred from a car frame within a hoistway onto a carriage.
Figure 6:
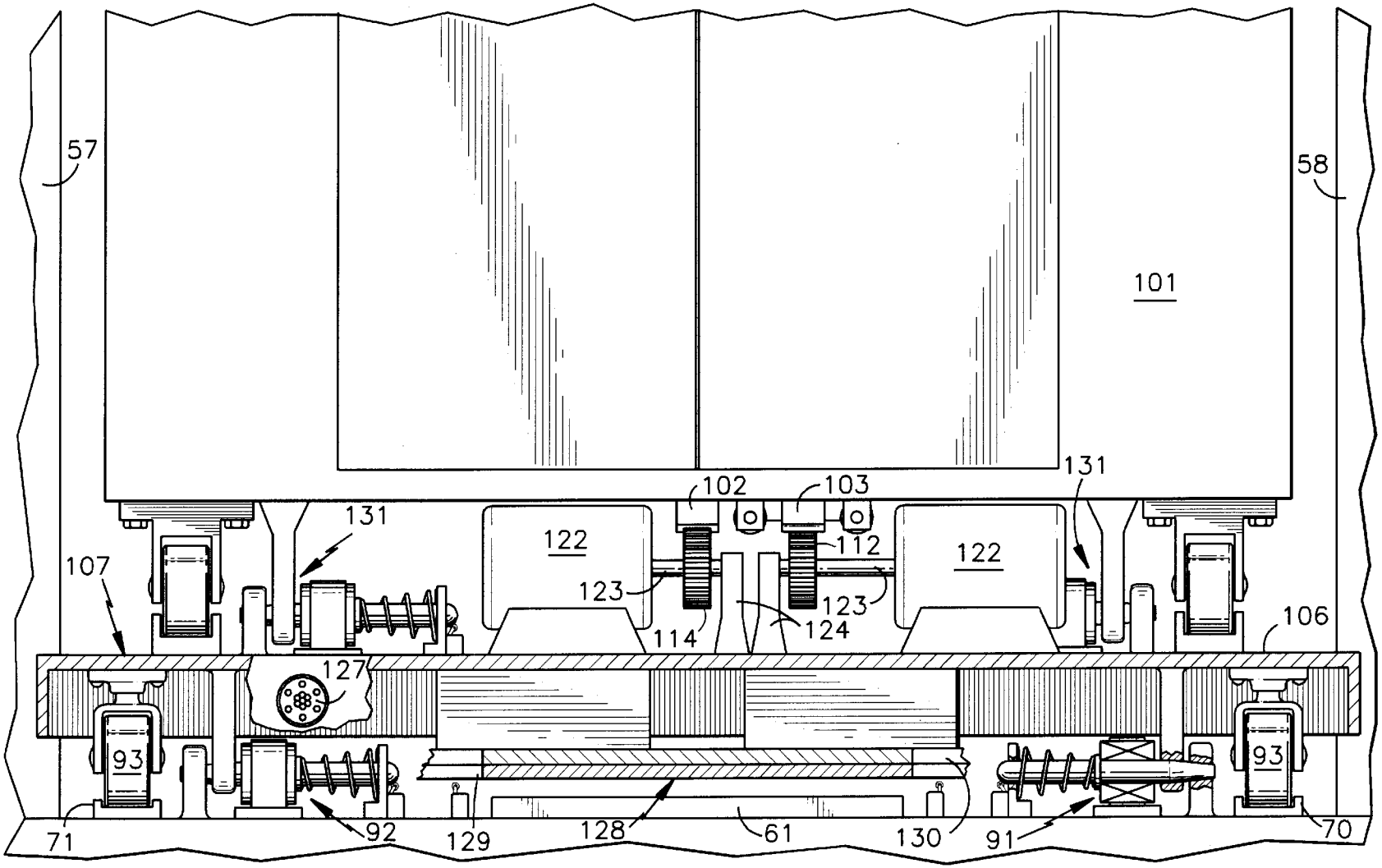
FIG. 6 is partially sectioned, partially broken away front elevation view of an elevator cab locked onto a carriage which in turn is locked onto the transport floor of FIGS. 1 and 2.

Referring now to FIG. 5 and FIG. 6, the best mode for transferring a cab between elevator cars and carriers at the transfer floor might be that disclosed in commonly owned U.S. patent application Ser. No. 08/663,569 filed on Jun. 19, 1996. In FIG. 5, the bottom of the elevator cab 101 has a fixed, main rack 102 extending from front to back (right to left in FIG. 5), and a sliding rack 103 that can slide outwardly to the right, as shown in FIG. 5. There are a total of four motorized pinions on each platform 104 of the elevator car frame 105 and on each platform 106 of each carrier 107. First, an auxiliary motorized pinion 111 turns clockwise to drive the sliding auxiliary rack 103 out from under the cab into the position shown in FIG. 5 where it can engage an auxiliary motorized pinion 112 on the platform 106 (not shown, behind the pinion 114), which is the limit that the rack 103 can slide. Then, the auxiliary motorized pinion 112 will turn clockwise pulling the auxiliary rack 103 (which now is extended to its limit) and therefore the entire cab 101 to the right as seen in FIG. 5 until such time as an end 113 of the main rack 102 engages a main motorized pinion 114 which is located just in front of the auxiliary motorized pinion 112 in FIG. 5. Then, the main motorized pinion 114 will pull the entire cab 101 fully onto the platform 106 by means of the main rack 102, and as it does so, a spring causes the slidable auxiliary rack 103 to retract under the cab 101. An auxiliary motorized pinion 115 can assist in moving the cab 101 to the right to a shuttle car frame, in the same manner as described for the pinion 111. A pinion behind the pinion 115 can pull a cab onto the carriage 107 from the right. Similarly, an auxiliary pinion 116 can assist in moving a cab from the car frame 104 to the left as shown in FIG. 5, and a pinion located behind pinion 116 can pull a cab onto car frame 104 from the left (although the high elevators in this embodiment will not do so).

To return a cab 101 from the platform 106 to the platform 104, the auxiliary pinion 112 will operate counterclockwise, causing the auxiliary rack 103 to move outwardly to the left until its left end 120 engages the auxiliary pinion 111 on the frame 104. Then, the auxiliary pinion 111 pulls the auxiliary rack 103 and the entire cab 101 to the left until the left end of the main rack 102 engages the main motorized pinion (not shown) located in line with the pinion 111 which then pulls the entire cab to the left until it is fully on the frame 104.

The details respecting the motors 122, shafts 123, pillow blocks 124 and the like are all set forth in the aforementioned application Ser. No. 08/663,869.

As shown in FIGS. 5 and 6, frame 104 of the carriage 107 supports the cab transfer mechanisms which have just been described. Suspended beneath the frame 104 is a LIM secondary 128 which consists of a layer 129 of a conducting metal, such as aluminum, backed by a layer 130 of magnetic material, such as iron. The secondary is in the shape of a cross, such that when the carriage is in the position indicated in FIG. 3 by the dashed lines 88 and the dot dash lines 86, each of the primaries 61, 62, 64, 65 will have a secondary adjacent to it. In this embodiment, the secondary extends to the extremes of the carriage 107 so that the secondary will just about reach the primaries 60, 63, 66 and 68, as well. This ensures that the LIM will be effective even across the dead spaces formed by the various wheel tracks. The X-Y LIM of the present invention can, through successive energization of the correct segments 60–67, and similar segments, with a suitable frequency to determine speed and current to determine force, cause acceleration, velocity and deceleration in a known fashion as required to move the carriage around the paths of the transfer floor 26. Thus, the transportation of the cab on the carriage occurs with the carriage being totally passive. However, to transfer a cab from an elevator car frame onto the carriage, or from the carriage onto an elevator car frame, the motors 122 must be energized appropriately. Therefore, electrical connections must be made between a carriage and a sill such as between a socket plug assembly 127 on the carriage and a related socket plug assembly 127*a* mounted in each of the sills (FIG. 5). In fact, each carriage will have two socket/plug assemblies 127, one on an edge as shown in FIG. 5, for interconnection at the high elevator sills and one on an edge as shown in FIG. 6 for interconnection with the low shuttle sills.

In transporting the carriage between a shuttle and a local elevator, the carriage motion controller, which controls the LIM, may respond to a network of proximity sensors (not shown) on the transfer floor, or the carriages may be provided with rotary position transducers operable distinctively in the X and Y directions, and transfer the bit information thereof to the controller in the building, either by a radio type transmitter or through the wheel tracks or other conductors on the floor by means of brushes. Or, the position may be tracked by inductive response in the LIM, or in any other suitable fashion. All of this is irrelevant to the present invention and may be selected to suit any given implementation thereof.

In FIG. 6, a pair of cab/carriage locks 131, which may be the same as the locks 91, 92 are utilized to ensure the cab is rigidly secure to the carriage during motion of the carriage with the cab on it. The locks, as described in the aforementioned application Ser. No. 08,565,658 are maintained in the locked position by a spring, and electrical current in a solenoid causes them to be unlocked. The current for unlocking these locks will also be applied, selectively, through the connectors 127, 128.

The methodology of the present invention includes the fact that prior to the elevators reaching the transport floors, carriages are called to the elevators where they will be needed, as described hereinafter. As described more fully hereinafter, when the carriers are not in use, each will simply remain locked in place at the hatchway of the elevator where it has last delivered a cab to an elevator, or be moved to a parking area.

Figure 7:
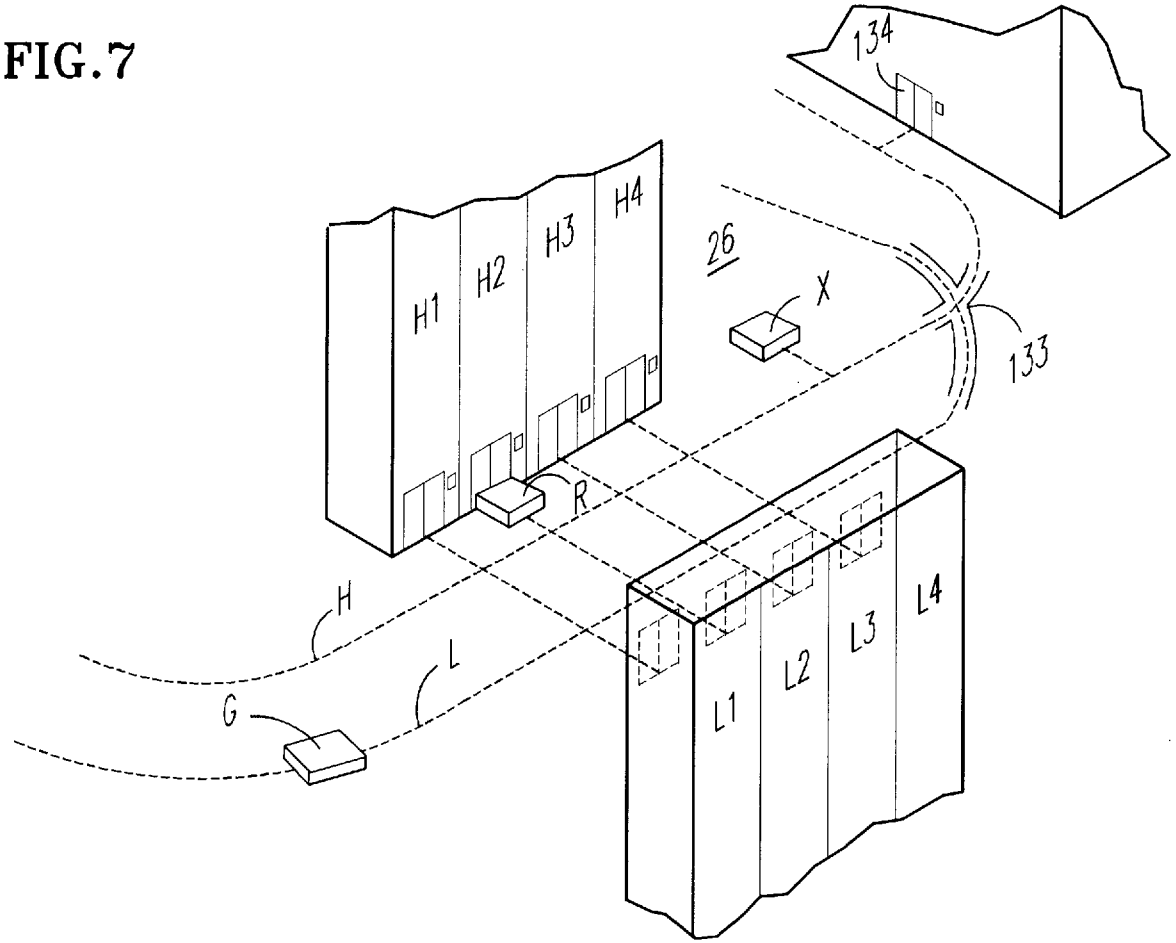
FIG. 7 is a partial, simplified perspective view of a portion of the system of FIG. 1, including a track crossing modification, a horizontal hall call stop, and nomenclature utilized in the logic flow diagrams of FIGS. 8–13 descriptive of operations at the transport floor.

Referring now to FIG. 7, the elevator system of FIG. 1 is shown as having a track crossing 133 so that whenever cabs arrive on the level 26 from the low shuttles L1–L4 on the low track, L, and travel around the transport floor 26, they will return to the elevator area on the high elevator track, H, so as to be in a position to more readily utilize one of the high shuttles H1–H4. This may support a bus mode of operation in which the cab always travels around the transfer floor between use of the L and H shuttles when going up or down. On the other hand, all of the description of a control means for the embodiment of FIGS. 1, 2 and 7 is equally applicable without the crossover 133. In fact, cabs can be moved from either track L, H to either shuttle L. H in either FIG. 1 or FIG. 7. FIG. 7 also illustrates a passenger landing 134 in which passengers traveling on the level 26 may exit a passenger cab. Although only one landing 134 is illustrated in FIG. 7, it should be understood that the invention contemplates many landings on the horizontal portion of the horizontal and vertical transportation system herein.

In FIG. 7, the nomenclature has been changed for simplicity in the descriptions which follow hereinafter. Instead of X1 and X2, the tracks are designated as H and L. A cab is designated G as it approaches the transfer area between the elevators L1–L4 and the elevators H1–H4. A carriage which has recently had a passenger cab transferred from it into one of the shuttles remains where it was, and is designated in FIG. 7 as R. An extra carriage, designated X, is parked out of the way of carriages traveling on the tracks H, L, to be brought into use when cabs are to be simultaneously exchanged between one of the low elevators and one of the high elevators, in the manner described in the parent application, or whenever the R carriage has been commandeered for travel on the transport floor. Although only a single extra carriage is shown, several extra carriages may be provided in order to ensure there will always be one available when needed. Whenever a cab is to leave one of the elevators L1–L4 or H1–H4 for travel on the transport floor 26, only a single empty carriage is required to receive the cab and carry it away. This carriage will be the carriage from a prior transfer onto a shuttle, designated R. When a cab is being brought along one of the tracks H, L toward the elevators it will be on a carriage designated G. In the embodiment which follows, it is assumed that the elevators always carry cabs, and never travel up and down without cabs in them. Therefore, before a cab riding on the carriage G can be transferred into an elevator, the cab which has arrived on that elevator must be carried away on the carriage R to make room for the cab that is on the carriage G, either to another elevator shuttle, or out on the transport floor 26.

Figure 8:
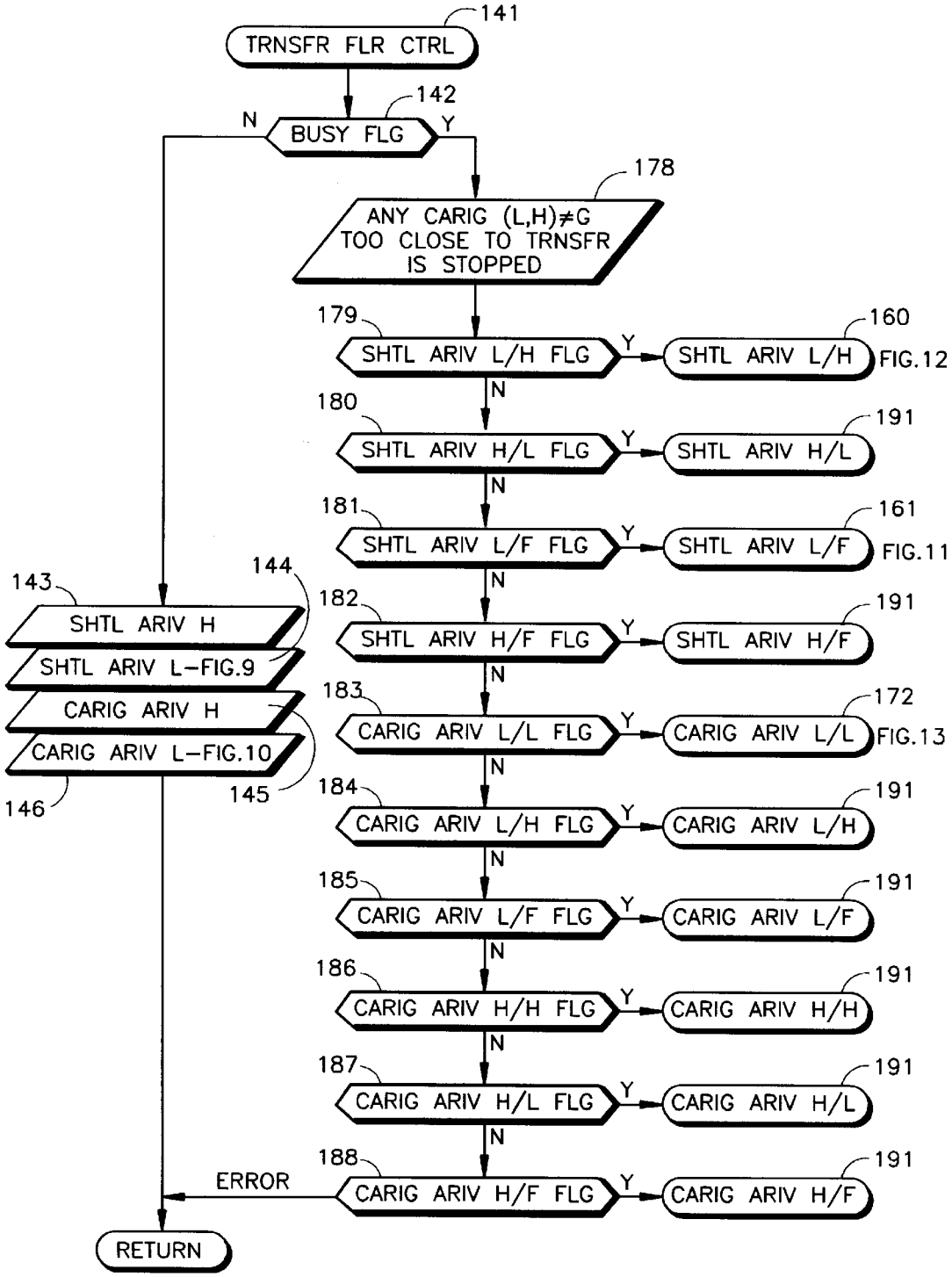
FIGS. 8–13 are simplified logic flow diagrams of exemplary routines for controlling cab transfers in the embodiments of FIGS. 1–7.

In FIG. 8, a transfer floor control routine is reached through an entry point 141 and a first test 142 determines if the system is already involved in cab transfers, in which case it is designated as busy. If the system is not busy, a negative result of test 142 will reach a series of routines 143–146 to see if either a shuttle is arriving at the transport floor 26 or a carriage is arriving at the transfer area for transferring a cab into one of the shuttles. In the control scheme about to be described, shuttles are generally given precedence over carriages because high speed vertical transportation is more traumatic to passengers than is the low speed horizontal transportation depicted herein. Thus, if the routines 143, 144 do not determine that a shuttle is arriving, then the routines 145, 146 will determine if a carriage is arriving.

Figures 9, 11, 12:
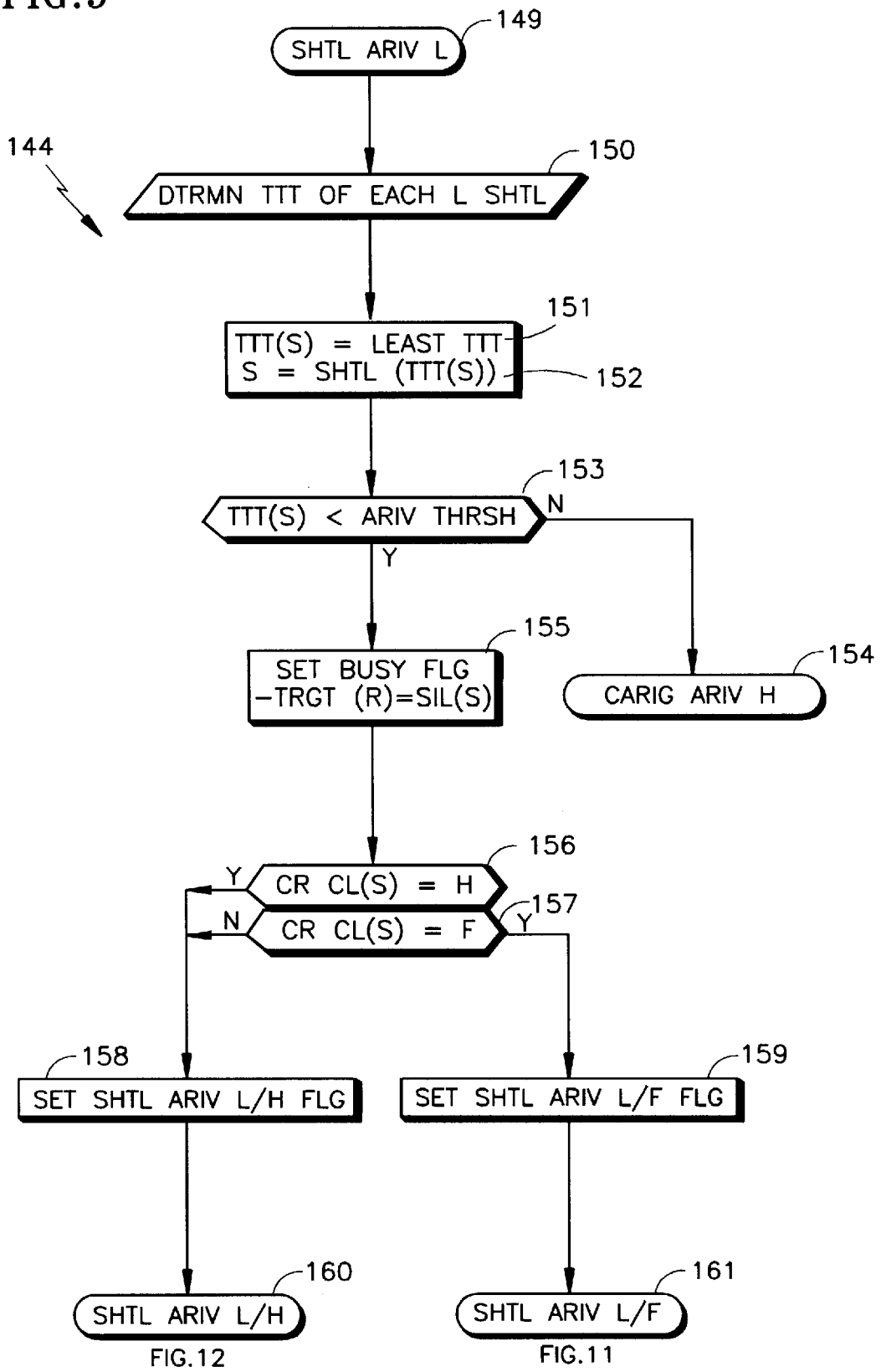

In FIG. 9, a shuttle arrive L routine (related to shuttles L1–L4) is reached through an entry point 149 and a first routine 150 determines the time to transfer (TTT) (the estimated time remaining to reach the transfer area) of each L shuttle, L1–L4. Then a step 151 designates the TTT for a selected shuttle S to be the least of the TTT's determined in the routine 150, then a step 152 designates a selected shuttle, S, as the shuttle having the least TTT provided in step 151. A test 153 determines if the TTT of the selected shuttle is below an arrival threshold, indicating that the shuttle's arrival is imminent and it must be handled. If the shuttle is not that close, a negative result of test 153 causes the carriage arrive H routine 145 (FIG. 8) to be reached through a transfer point 154. But if the shuttle is close, an affirmative result of test 153 causes a pair of steps 155 to set the busy flag (that used in test 142 of FIG. 8) and to set the target position for the remaining carriage, R, to the sill of the selected shuttle, S. Then a pair of tests 156, 157 determine if the selected shuttle has car calls for the high shuttles H1–H4 or for the transport floor, F (meaning a requirement to deliver passengers somewhere on the level F by means of horizontal transportation). The tests 156–157, in this embodiment, are arranged so that if there are no car calls it is assumed that the cab should pass from the low shuttles to the high shuttles so a negative result of test 157 is the same as an affirmative result of test 156. In either case, an appropriate flag is set in a corresponding step 158, 159 and the program advances to an appropriate routine to either transfer the cab to the high elevators through a transfer point 160 or to transfer a cab for horizontal transportation on the floor, through a transfer point 161. The shuttle arrive H routine 143 (FIG. 8) is essentially the same as that described for the low elevators in FIG. 9, with obvious changes.

Figures 10, 13:
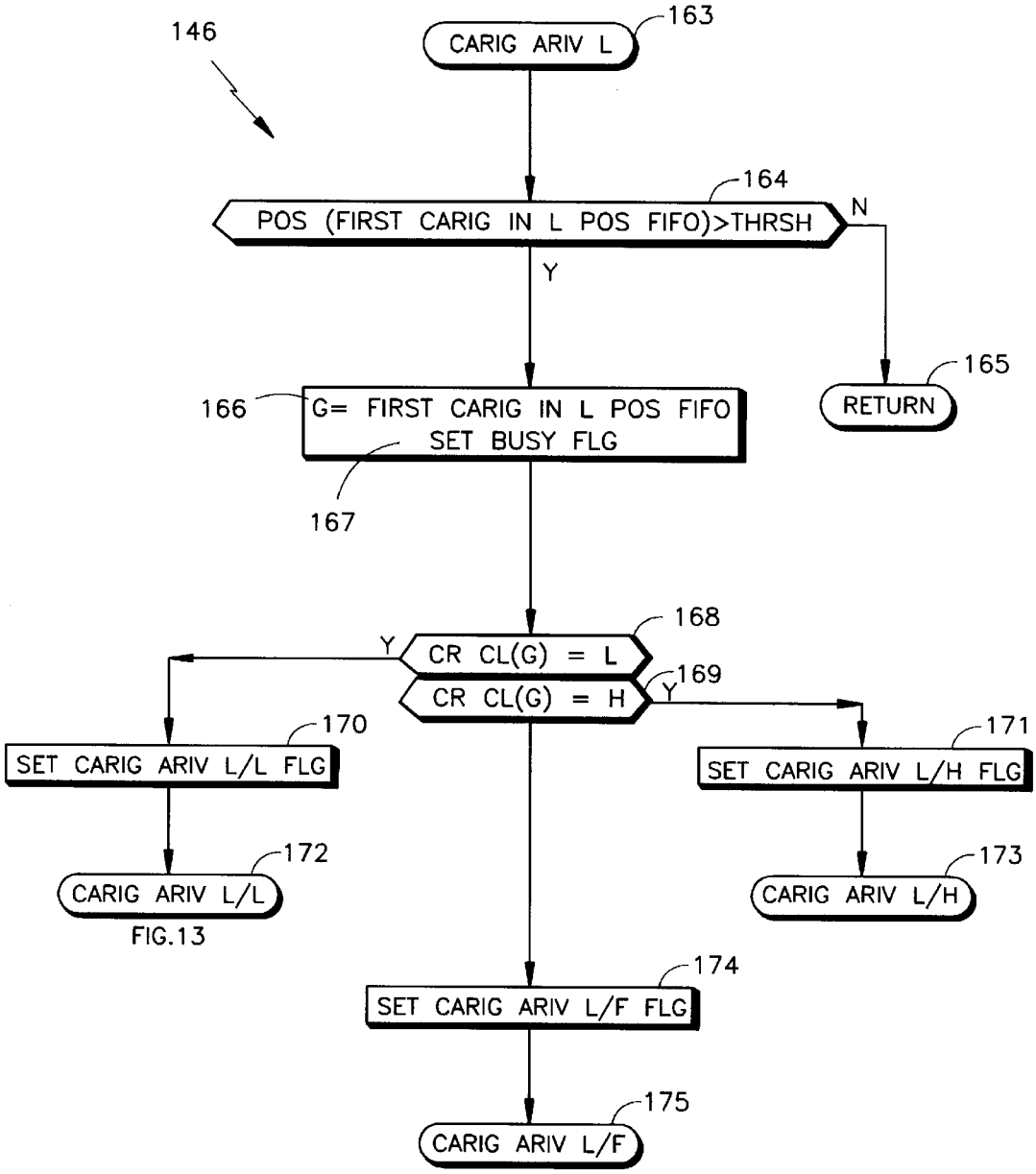
Figure 11:
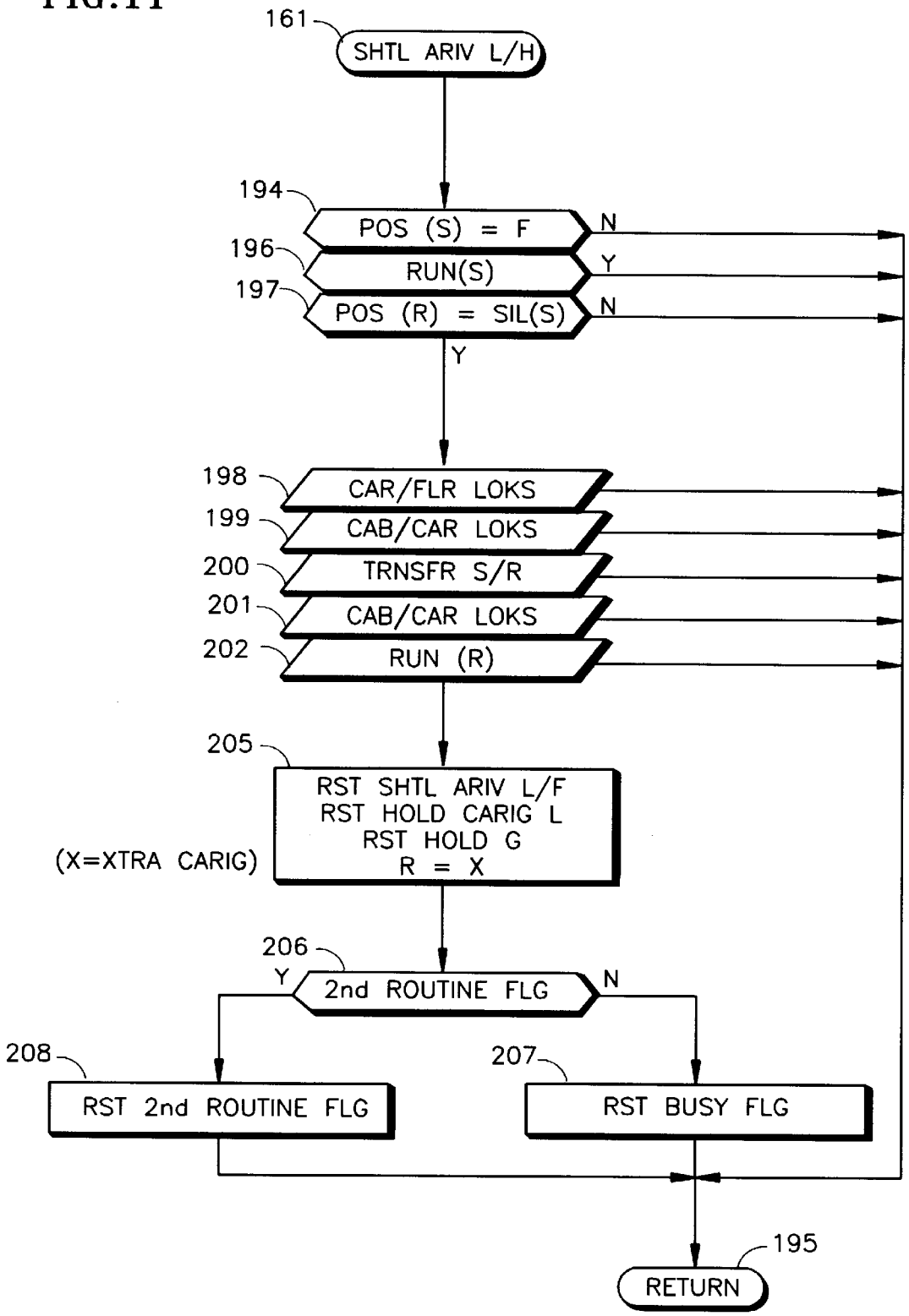
Figure 12:
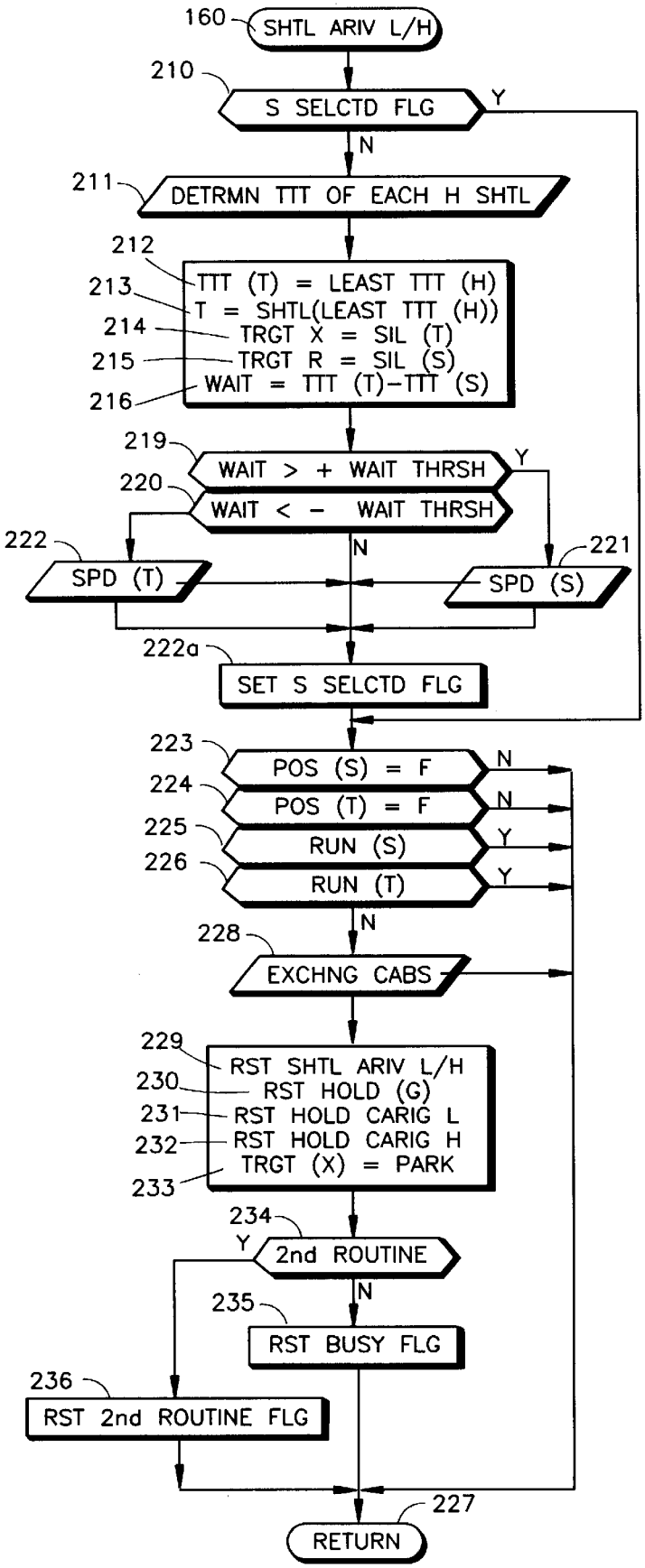
Figure 13:
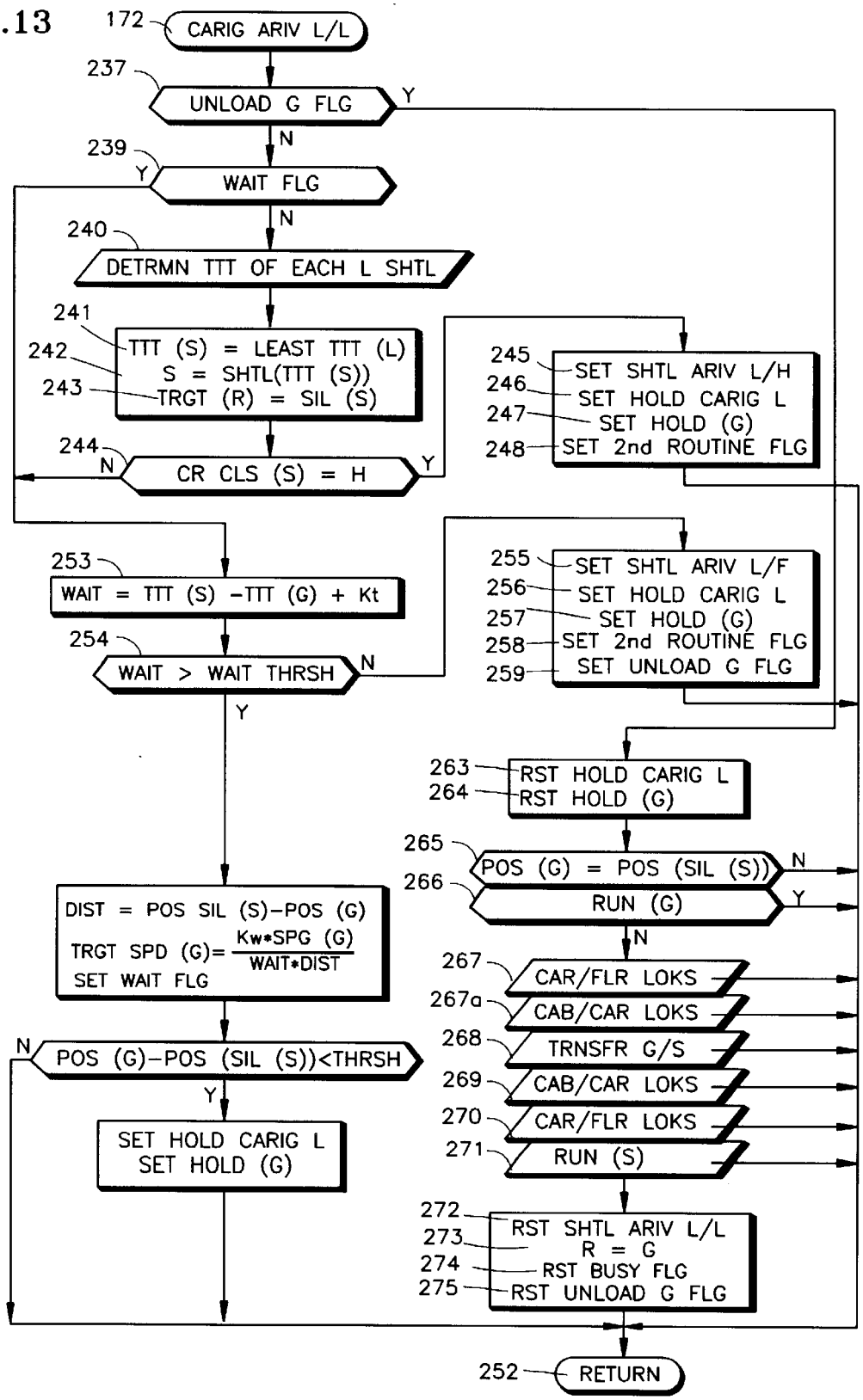

In FIG. 10, the carriage arrive L routine 146 is reached through an entry point 163 and a first test 164 determines if the position of a carriage, in first in, first out storage (FIFO) related positions of carriages on the L track, is greater than a threshold, using a position convention which assumes position values increase as a carriage travels counterclockwise around the L track (FIG. 7) and become maximum at L4 and H4. If the position of the closest car to the transfer area is not greater than the threshold, then it is deemed that its appearance at the threshold area is not imminent and the carriage need not be dealt with. If the closest carriage on the L track does not require immediate service, a negative result of test 164 causes other programming to be reverted to through a return point 165. But if the closest carriage is sufficiently close that its need for transfer service is imminent, an affirmative result of test 164 reaches a step 166 which identifies a selected carriage, G, as the first carriage in the track L position FIFO. And a test 167 sets the busy flag to indicate that a transfer is about to take place. Then a pair of tests 168, 169 determine if car calls within the cab on carriage G include calls involving the low shuttles or the high shuttles respectively. If so, a corresponding flag will be set in an appropriate step 170 or 171, and either the carriage arriving on track L for an L shuttle routine will be reached through a transfer point 172 or a carriage arrival on the L track for an H shuttle routine will be reached through a transfer point 173.

The convention on car calls on a cab traveling horizontally on the level 26 (or similarly in other levels) in this embodiment assumes that the first car call registered will establish the destination for the cab, which is then displayed to passengers so they can choose to enter the cab or not. In that way, only car calls for the low shuttles, or for a transport floor 27 which can be reached by the low shuttles or for the high shuttles, or for the transport floor 26 on which the cab is already traveling horizontally can be made. If both of tests 168 and 169 are negative, then either a car call has been registered for the transport floor or no car call has been registered. The protocol in this embodiment is that a car which is not scheduled to service a passenger in or through one of the shuttles will simply go around on the transport floor. Therefore, negative results of both tests 168 and 169 will reach a step 174 to set an appropriate flag, and then reach the carriage arrive on track L for travel on the floor (L/F) routine through a transfer point 175.

Referring once again to FIG. 8, should any of the routines 143–146 determine that service is required to handle a cab arriving on a carriage or a shuttle, the busy flag will have been set so that in a subsequent pass through the routine of FIG. 8, test 142 is affirmative. In each case, if desired, a routine 178 may be utilized to determine if any carriage is getting too close to the transfer area, other than the carriage designated as G, which will be accommodated. If so, such carriages can be stopped. The reason for this is to accommodate the fact that shuttle transfers will take precedence over carriage transfers. A series of tests 179–188 determine if any flags of the type described hereinbefore with respect to steps 158, 159 (FIG. 9) and 170, 171 and 174 (FIG. 10) have been set or not. If so, affirmative results of any of the tests will cause the program to return t one of the routines which needs to be performed, by reaching an appropriate transfer point such as the transfer points 160, 161 and 172 described in FIGS. 9 and 10 hereinbefore, and additional similar transfer points 191.

Assume that test 181 is affirmative; the program will enter the shuttle arrive L/F routine in FIG. 11 through the transfer point 161. A first test 194 determines if the position of the selected shuttle is the floor (F) (that is, transport floor 26, FIG. 7). If not, it is not yet time to handle the cab which is arriving on the selected shuttle, so a negative result of test 194 causes other programming to be reverted to through a return point 195. In the next pass through the routine of FIG. 8, tests 142 and 181 will still be affirmative, once again reaching the routine of FIG. 11. Eventually, the selected shuttle will reach the floor so test 194 will be affirmative reaching a test 196 to see if the run condition of the selected shuttle has ended or not. If not, other programming is reached through the return point 195. But when the selected shuttle is no longer in the run condition, an affirmative result of test 196 reaches a test 197 to see if the position of the remaining cab, R, is the sill of the selected shuttle; if not, other programming is reverted to, but if so, a series of routines 198–202 are performed in order to lock the shuttle and the carriage to the building with car floor locks, unlock the cab car locks on the carriage and on the elevator car frame of the shuttle, transfer the cab from the shuttle to carriage R, lock the cab with car locks on the shuttle R, and cause R to run in accordance with whatever car calls were established in the cab. These routines are as set forth in the parent application and in the aforesaid application Ser. No. 08/663,869, and are not repeated here. In FIG. 11, the routines 198–202 are shown as including paths to the return point 195. This permits other programming to be performed while waiting for the actual movement of car locks, the actual transfer of the cab, and the like, rather than tying up the processor for the 10 or 15 seconds required to perform all these mechanical tasks. Then, a plurality of steps 205 reset the shuttle arrive L/F flag, reset a flag that will cause a carriage on the L track to be held in place, as described hereinafter, redundantly reset a flag that might have held carriage G in place on the L or H track, (here, it was already reset) and set R equal to X so that the extra carriage will be the next carriage used in offloading a cab from one of the shuttles. However, the extra carriage can remain parked as shown in FIG. 7 until it is commanded to move to one of the L sills or one of the H sills.

The routine of FIG. 11 may be called by the routine of FIG. 13, as described hereinafter. If it is, the routine of FIG. 13 will set a "2nd routine flag" indicating that the routine of FIG. 11 was called by some other routine. If that is the case, an affirmative result of a test 206 will reach a step 208 that simply resets the second routine flag. On the other hand, if the flag is not set, indicating that a shuttle has instituted the process (rather than a carriage) then the negative result of the test 206 will reach a step 207 which will reset the busy flag indicating to the transfer floor control routine of FIG. 8 that it should once again look for the imminent approach of a carriage or shuttle that will require transferring a cab. And then, other programming is reverted to through the return point 195.

Assume that the shuttle arrive L routine 144 of FIG. 9 now determines that a shuttle is arriving on the low elevators with a cab that must be transferred to a high elevator. In such case, the busy flag will be set in one of the steps 155 and the step 158 will set the shuttle arrive L/F flag and cause the shuttle arrive L/H routine of FIG. 12 to be reached through the transfer point 160. A first test determines if a high shuttle has been selected to work with the low shuttle for the required movement of the cab. Initially, it will not have, so a negative result of test 210 reaches a routine 211 which will determine the time to transfer (TTT) of each high shuttle 211, so as to pick the high shuttle which will next be available to exchange cabs with the arriving low shuttle. A step 212 determines that the TTT of a selected shuttle, T, is the least TTT determined in the routine 211, a step 213 identifies the selected high shuttle, T, as that shuttle having the least TTT. A step 214 sets the target for the extra cab, t, to the sill of the selected high shuttle, T; the target position for the remaining cab R is set equal to the position of the sill of the selected low shuttle which is about to arrive, in a step 115, and a wait value, indicative of the amount of time that one of the shuttles will have to wait until the other shuttle arrives is determined in a step 216. Then a pair of tests 219, 220 determine respectively whether the low shuttle S will have to wait for high shuttle T, or whether the high shuttle T will have to wait for the low shuttle S, by more than threshold amounts. In the first instance, an affirmative result of test 219 will reach a routine 221 to control the speed of the low shuttle to slow it down so that the passengers will not be retained in a non-moving cab for more than the wait threshold period of time, which may be on the order of 10 or 20 seconds. The speed routine 221, and a similar routine 222 which may be used for the high shuttle T if appropriate, may take the form described in commonly owned U.S. patent application 08/666,181 filed Jun. 19, 1996. On the other hand, if not desired in any embodiment of the invention, the steps and routines 219–222 may be eliminated. In any case, if the difference in TTT of the two shuttles is less than the threshold, then the routines 221, 222 will be bypassed. And then, the S selected flag is set in a step 222*a*.

Arrival of the two shuttles is signaled by results of a pair of tests 223, 224 being affirmative. Then a pair of tests 225, 226 determine when both shuttles are no longer in the run condition. Prior to that, negative results of tests 223, 224 or affirmative results of tests 225, 226 will cause other programming to be reverted to through a return point 227. In each subsequent pass through the routine of FIG. 12, the routine bypasses the selection process by virtue of an affirmative result of the test 210. When both shuttles are present and no longer running, a routine 228 may be performed to accomplish all the locking and unlocking steps and movement required to exchange cabs, the cab on the low shuttle S being placed onto the carriage R and the cab on the high shuttle T being placed on the carriage X, and then these cabs in turn being placed on the high shuttle T and the low shuttle S, respectively. The routine 228 may be as described in several routines of the parent application. The conclusion of such routines will reach a series of steps 229–233 to reset shuttle arrive L/H, since the job is complete, to reset any hold which might be placed on carriage G, which may have been applied as described hereinafter, to reset a hold on carriages either on track L or track H, to set the target for the extra cab to be its parking place so as to move it out of the way. Then the second routine flag is interrogated in a test 234; if affirmative, it is reset in a step 236; if negative, a step 235 will reset the busy flag so that the routine of FIG. 8 can once again determine if the need for service is imminent elsewhere. And then other programming is reverted to through the return point 227. In the next pass through the routine of FIG. 8, the busy flag is still set so test 142 is affirmative but test 179 is affirmative causing the program to divert to the shuttle arrive L/H routine of FIG. 12 through the transfer point 160. That entire routine will be performed, it independently reidentifying the low shuttle S as being the closest one, and taking a high shuttle with which it will work. When the cabs of the two shuttles have been exchanged, because of the second routine flag set in step 248 of FIG. 13, the busy flag is not reset in step 235; instead, the second routine flag is reset in step 236.

Then a subsequent pass through FIG. 8 will find an affirmative result of test 142, a negative result of test 179, being steered by an affirmative result of test 183 through the transfer point 172 back to the carriage L/L routine of FIG. 13.

Although not shown in FIG. 12, the car calls within the high shuttle may be examined, and if car calls are for the transport floor 26, then when the exchange cabs routines 228 are performed, instead of loading the cab from the high shuttle onto the low shuttle, it can simply be sent on its way on the high track. This is an obvious modification which is not described further.

Assume now that the carriage arrive L routine 146 of FIG. 10 determines that a carriage is arriving on the low track, L, with a cab having car calls requiring the use of a low shuttle (that is, either at the lobby or at some lower horizontal transportation landing such as on the transport floor 27). In such case, step 170 in FIG. 10 will have set the carriage arrive L/L flag and the carriage arrival routine of FIG. 13 will be reached through the transfer point 172. In order to move a cab from a carriage to a shuttle, in this embodiment, a shuttle must arrive at the transfer floor 26, and its cab must be dealt with prior to being able to receive a cab from the approaching carriage. In FIG. 13, a first pair of tests 237, 239 involve flags used to control advancement through the routine of FIG. 13; these are initially negative reaching a subroutine 240 to determine the time to transfer (TTT) of each low shuttle. This is to find the first shuttle that will become available to take any cab from the approaching carriage. A step 241 establishes the TTT of the selected shuttle to be the least TTT determined in the subroutine 240, a step 242 identifies the selected shuttle as that having the least TTT, and a step 243 sets the target for the R carriage to be equal to the sill of the selected shuttle S. A test 244 determines if the selected shuttle has car calls for the high shuttles or requiring transfer to the high shuttles for a subsequent horizontal destination. If it does, then that cab will have to be transferred to one of the high shuttles which in turn may require transfer to a high shuttle having a cab destined for the low shuttle. In other words, it might be that the shuttle selected in the steps 241–243 cannot handle the cab now approaching on the selected carriage, G. If test 244 is affirmative, a step 245 will set shuttle arrive L/H since this cab will have to be dealt with first. Then a step 246 will set old carriage L and a step 247 will set hold G so as to put transfer from carriage G on hold ending handling the cabs involved with the low and high shuttles. Then a step 248 sets the 2nd routine flag, and other programming is reached through a return point 252. In a subsequent pass through FIG. 8, test 142 is affirmative but test 179 is affirmative so that test 183 is not reached. In other words, both flags for shuttle arrive L/H and shuttle arrive L/L are on at the same time but the routine will take care of the cab which needs to be moved from L to H by virtue of the arrangement of FIG. 8. Therefore, the routine of FIG. 12 will be performed and the cab on the low shuttle will be transferred to the high shuttle.

In FIG. 13, tests 237, 239 are negative, once again reaching the routine, steps and tests 240–244 to find a selected low shuttle, S, which does not have a cab that must be transferred into the high shuttles. Assuming this has happened, a negative result of test 244 reaches a step 253 to generate a wait value equal to the difference between the TTT of the shuttle and the TTT of the approaching carriage G, plus some transfer time, Kt, which is required to remove the cab from the approaching shuttle before the cab on carriage G can be placed thereon. A test 254 determines if the wait value is greater than a threshold. If it is not, step 255 sets the shuttle arrive L/F, steps 256, 257 hold carriage L and carriage G, step 258 sets the 2nd routine flag, and step 259 sets an unload G flag. In the next pass through FIG. 8, test 142 is affirmative and test 181 is affirmative causing the program to revert to FIG. 11, without reaching test 183. Thus, the routine of FIG. 11 is performed so as to cause the cab arriving on the selected low shuttle S to be removed from the shuttle and sent on its way on the carriage R, as described with respect to FIG. 11 hereinbefore.

When the cab on the low shuttle has been placed on a carriage and moved out on the L track, the test 206 in FIG. 12 causes the busy flag to not be reset but rather the 2nd routine flag to be reset in a step 208, after which other programming is reverted to through the return point 195. In the subsequent pass through the routine of FIG. 8, test 142 is still affirmative but this time test 181 is negative so that test 183 is again reached causing the program to revert to FIG. 13. However, since step 259 had set the unload G flag, this time test 237 is affirmative reaching a pair of steps 263, 264 to reset hold carriage L and to reset hold G. Then a pair of tests 265, 266 determine if carriage G has reached sill S and stopped running; until that is the case, other programming is reached through the return point 252. When carriage G is stopped at sill S, a negative result of test 266 will reach a series of subroutines 267–271 to lock the carriage to the floor, unlock the cab car locks on the carriage G, and transfer the cab from carriage G onto the empty shuttle S; lock the car locks of the shuttle S, unlock the car floor locks of shuttle S and cause S to run. All these routines are of the type disclosed in the aforementioned copending applications.

When shuttle S has left with a cab, a series of steps 272–275 reset carriage arrive L/L, identify the remaining carriage R as being carriage G (which is standing at sill S empty) reset the busy flag and reset the unload G flag Thus, the routines of FIGS. 8–13 (and other similar routines identified on FIG. 8) allow vertical and horizontal transportation, with the exchange of cabs at the interface between the horizontal and vertical transportation, without in any way interfering with the needs for orderly flow of passenger cabs in the elevator portion of the system.

Figure 14:
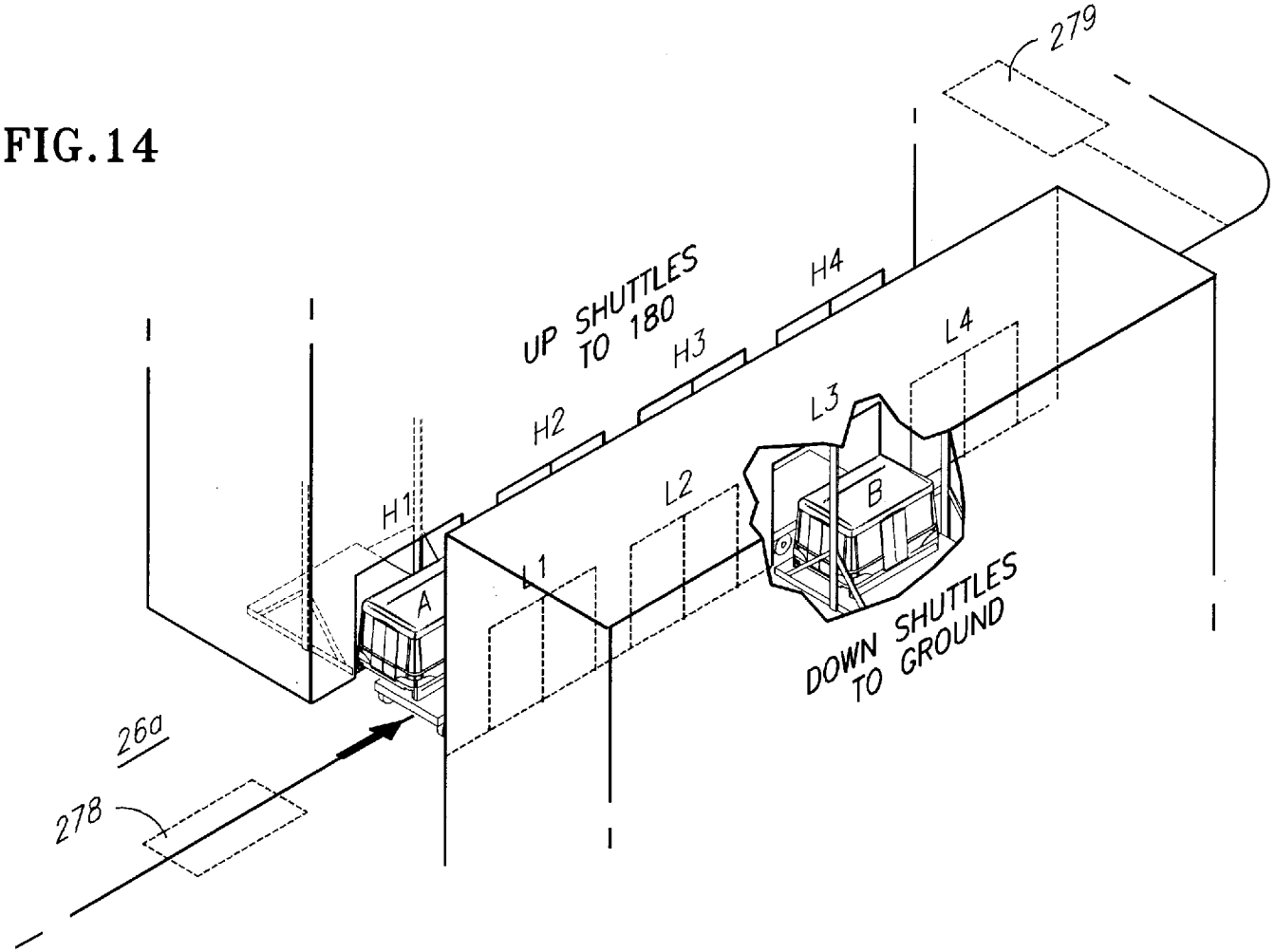
FIG. 14 is a partial, simplified perspective view of a transport floor similar to that of FIGS. 1, 2 and 7, but having a single horizontal track.

Referring to FIG. 14, the practice of the present invention, based primarily on the apparatus of the parent application as described hereinbefore, can also easily be practiced with a single track. All that is required is that the first cab to be loaded from a shuttle onto a carriage in the transfer area of the transport floor 26*a* be moved out of the way such as to a position 278 while another carriage, such as one in the parked position 279, can be brought in to move a cab from another shuttle to the shuttle which was just rendered empty. This is basically simpler than the routines described in FIGS. 8–13, except for the additional moving step.

Figure 15:
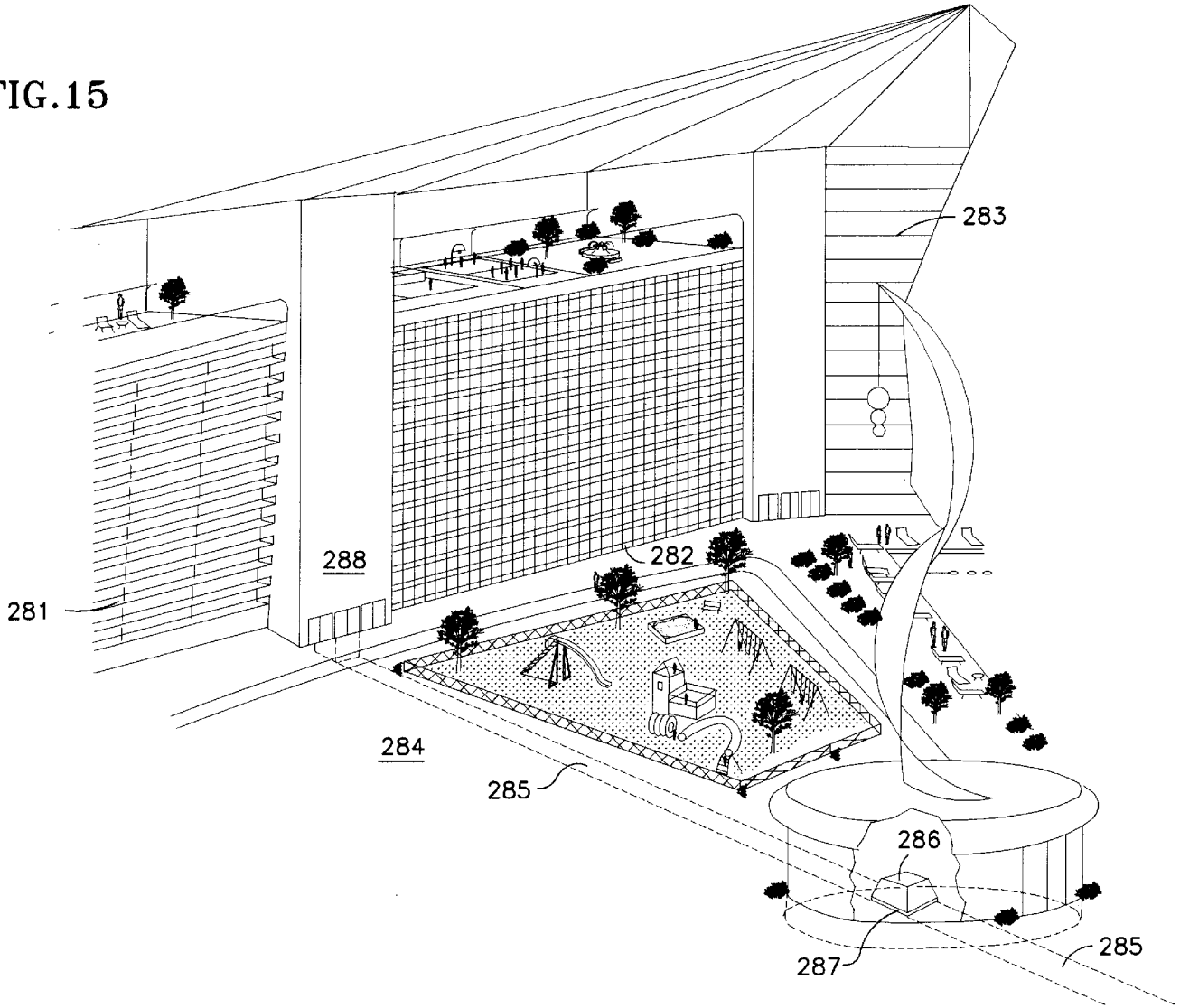
FIG. 15 is a perspective view of an upper level in a hypertall building utilizing horizontal and vertical transportation of passengers according to the invention in which a different form of transfer mechanism is employed.

To transfer the cab from a car frame to a carriage, the embodiments of the invention described hereinbefore utilize lateral cab motion; that is, motion which is perpendicular to the direction of carriage movement. The invention may also be practiced in embodiments in which the cab is transferred between a carriage and a car frame longitudinally; that is, in the same direction as motion of the carriage. FIG. 15 illustrates a horizontal/vertical transportation system, which may obtain at an upper level of a hypertall building. Therein, a plurality of building sections 281–283 may surround a park-like area 284 beneath which horizontal transportation tracks 285 allow a cab 286 to transfer passengers horizontally, and allow them to get on and off, such as at a call landing 287. The tracks 285 are also in communication with an elevator 288 so that passengers can travel between the various floors of the buildings 281, 282 and the park-like area 284 and other areas on that level, in the same cab, such as cab 286. In this instance, the cab 286 will be transferred longitudinally from a bogey on the tracks 285 into an elevator car frame within the hoistway of the elevator 288.

Figure 16:
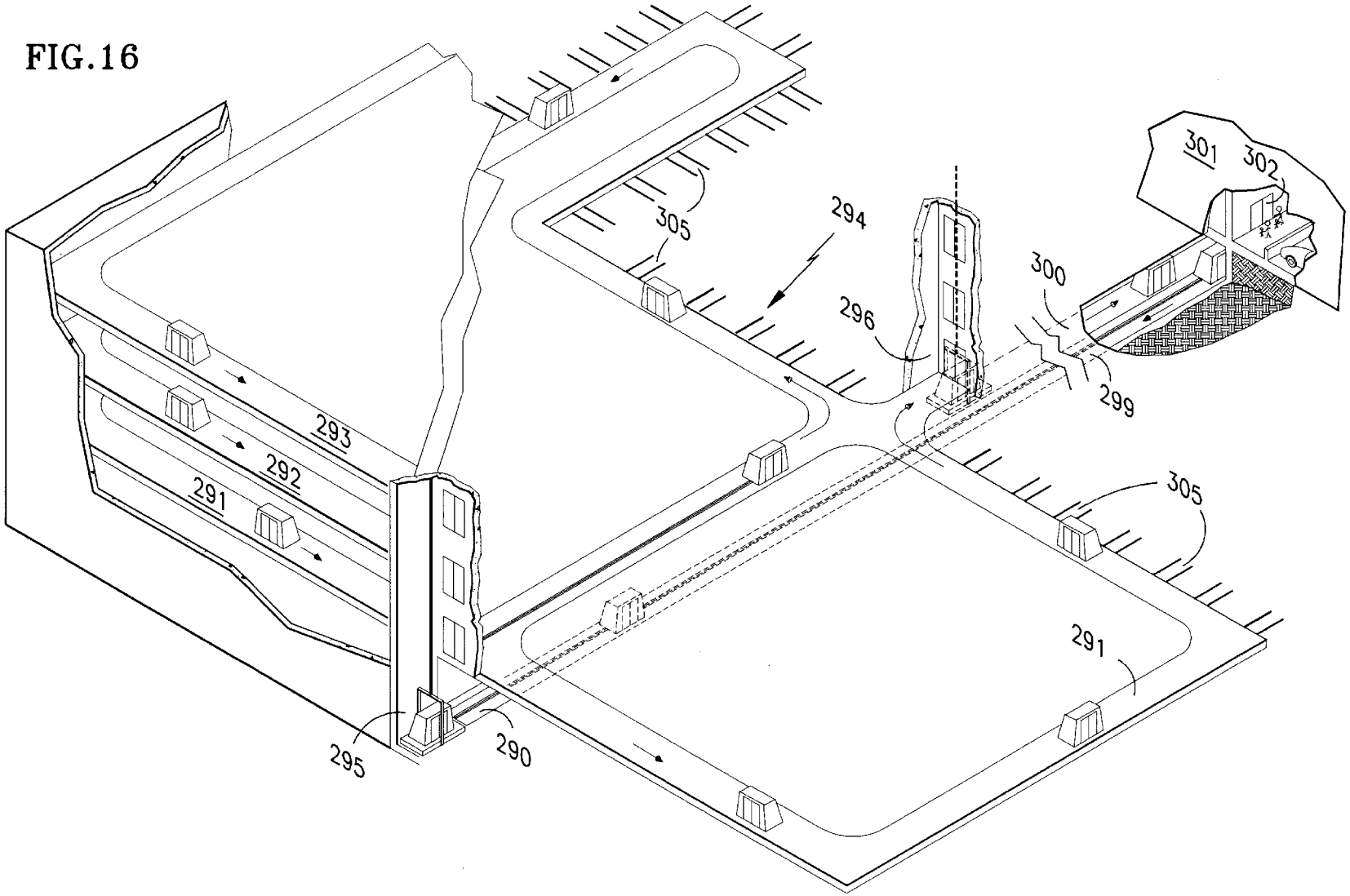
FIG. 16 is a partially broken away, simplified perspective view of a plurality of horizontal levels having cabs traveling thereon, the levels being interconnected by elevator shuttles.

FIG. 16 shows another situation in which longitudinally transferred elevator cabs may be utilized. In FIG. 16, there are a plurality of levels 290–293 in a first structure 294 which is served by a pair of elevators 295, 296. The structure 294 may be connected by horizontal tracks 299, 300 to a totally different structure 301 located some distance from the structure 294. The structure 301 may also include elevators such as an elevator 302 into which cabs may be transferred for vertical transportation. In FIG. 16, the elevators 295, 296 are depicted as being employed in a scheme in which cabs will be moved upwardly to a desired floor in the elevator 295 and carried downwardly from level 291 in elevator 296. However, other schemes may be employed, that shown being exemplary merely. As shown on the level 291, the cabs may stop at a plurality of landings 305 any one of which may be identified for an intended stop by pressing a car call button in the corresponding cab or a hall call button at the stop. Should a cab be loaded on the elevator 295 with a car call for a level such as 292 or 293, the elevator 295 can raise the cab to that level before transferring it to a bogey on that level. Similarly, one or more cabs may be run in a bus mode in which each cab travels around each level and then goes to the next level and travels around it. The mode of operation in the various horizontal levels, and therefore the nature of exchanges between the elevators are irrelevant to the invention, there being an unlimited number of ways in which vertical and horizontal transportation can be combined.

Horizontal and vertical transportation of the present invention may be achieved utilizing longitudinal transfer of the type illustrated briefly in FIGS. 15 and 16, in a manner which is fully set forth in a commonly owned, copending U.S. patent application Ser. No. 08/749,295, filed contemporaneously herewith. The longitudinal transfer described therein is illustrated briefly in FIGS. 17 and 18.

Figures 17, 18:
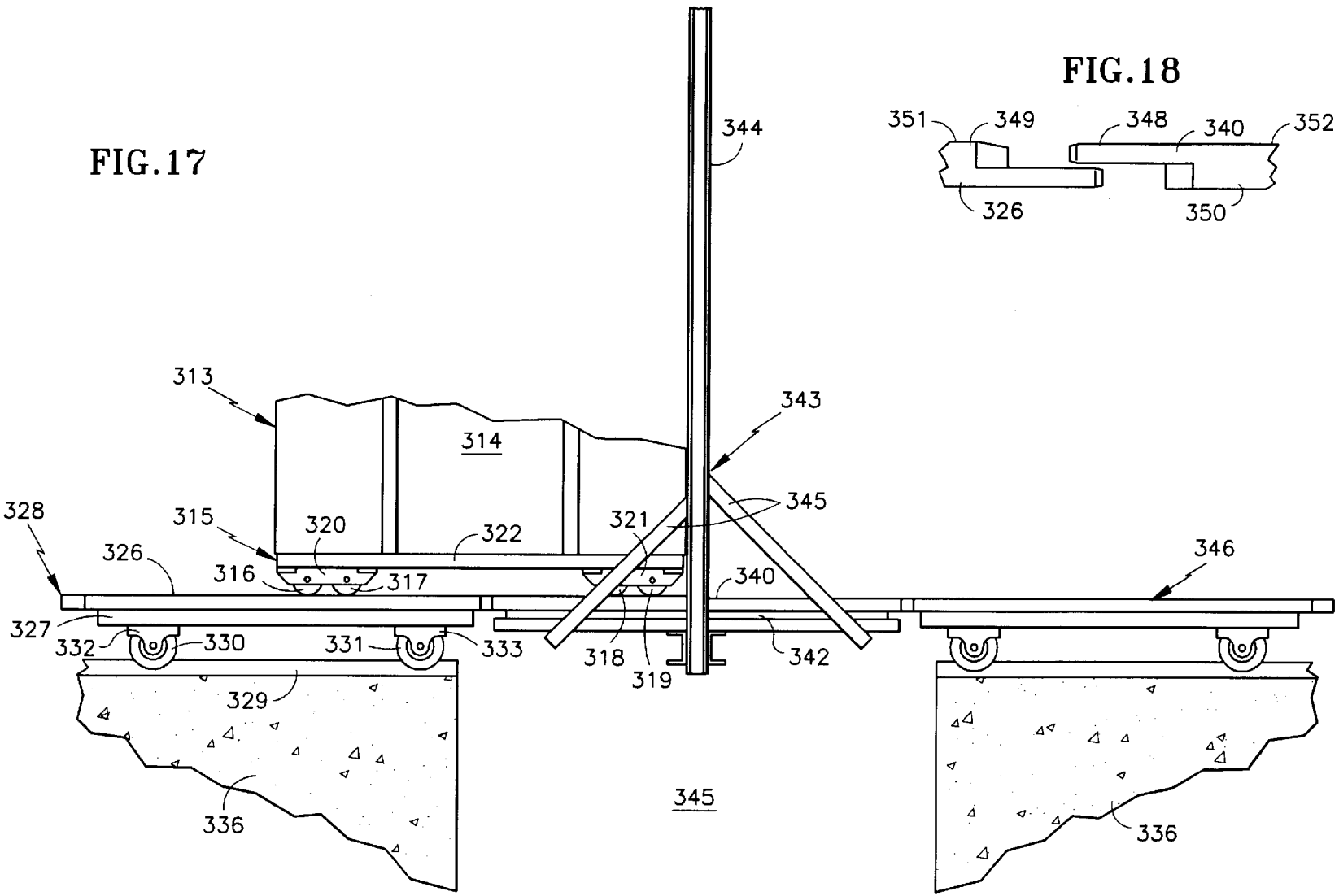
FIG. 17 is a partial, partially broken away, simplified side elevation view of a passenger cab being transferred between a bogey and an elevator car frame in a manner suitable for use in the embodiments of FIGS. 15 and 16.
FIG. 18 is a fragmentary top plan view of the bogey and car frame rails of FIG. 17.

Referring now to FIG. 17, a cab 313 includes a passenger compartment 314 and a carriage 315. The carriage 315 has wheels 316–319 disposed on brackets 320, 321 attached to a frame 322. The reverse side of the carriage 315 has four similarly-positioned wheels.

The wheels 316, 317 are shown being supported by a rail 326 disposed on a platform 327 of a bogey 328 which in turn can move along tracks 329 on wheels 330, 331 which are disposed to the platform 327 by journals 332, 333. The reverse side of the bogey 328 has additional wheels which ride on a track (not shown). The tracks 329 are disposed to the building structure 336.

The wheels 318, 319 are shown being supported by a rail 340 supported on a platform 342 of an elevator car frame 343, which includes stiles 344 and braces 345 of a conventional sort. The car frame 343 is disposed in a hoistway 345 for vertical motion, such as by means of a typical elevator traction machine connected to the car frame and a counterweight by roping, or by means of any other suitable motor. The nature of the elevator with which the invention is used is irrelevant to the invention. Another bogey 346 may similarly be moveable on other tracks supported in the building, and is not described further.

In the aforementioned application Serial No. 08/749,295, the bogeys 328, 346 each have linear motor primaries disposed thereon and the carriage 315 beneath the cab 313 has linear motor secondaries extending throughout its length (from right to left as seen in FIG. 17). Linear displacement transducers are utilized to control the operation of the linear motors so as to move the cab 313 from a bogey 328 into a car frame 343, or vice versa.

Referring to FIG. 18, the rail 340 is scarfed on the outside, so as to provide a half-lap temporary joint as illustrated with the rail 326. In FIG. 18, a minimal overlap 348 of the rails 326, 340 is illustrated, which may be on the order of one inch (two and one-half centimeters), which is adequate; but a two or three inch (five-seven centimeter) overlap may be used. The bogey 328 may have a buffer (not shown) to absolutely arrest its motion without any interference between the rails 326 and the rails 340.

The spacing of the wheels 316 and 317 as well as 318 and 319, and the spacing of other pairs of wheels on the reverse side of the carriage 315, is sufficiently great so that either one wheel 316, 318 or the other 317, 319 is supported by a full section of rail 349, 350 at all times. Similarly, guide rollers (not shown) are sufficiently spaced so that one roller or the other of each pair is on the flat inside edge 351, 352 of the rails 326, 340 at all times. Therefore, the combination of scarfing of the rails and spacing of the wheels and rollers provides a smooth ride. Smoothness and quietness are also enhanced by various tapers provided at the ends of the rails.

In the embodiment of FIGS. 1–14, the operation is controlled in a manner that supports the needs of the relatively tall shuttles to rapidly and reliably deliver their passenger cabs. The embodiment of FIGS. 15–17 may be operated in a different manner, in which the elevators are called to whichever position they are needed, and will travel to those positions with no cabs in them, after which they will receive a cab and deliver the cab to the desired level. In the following description, the elevator and its car frame is referred to as the shuttle and the carriage is referred to as the bogey.

Figure 19:
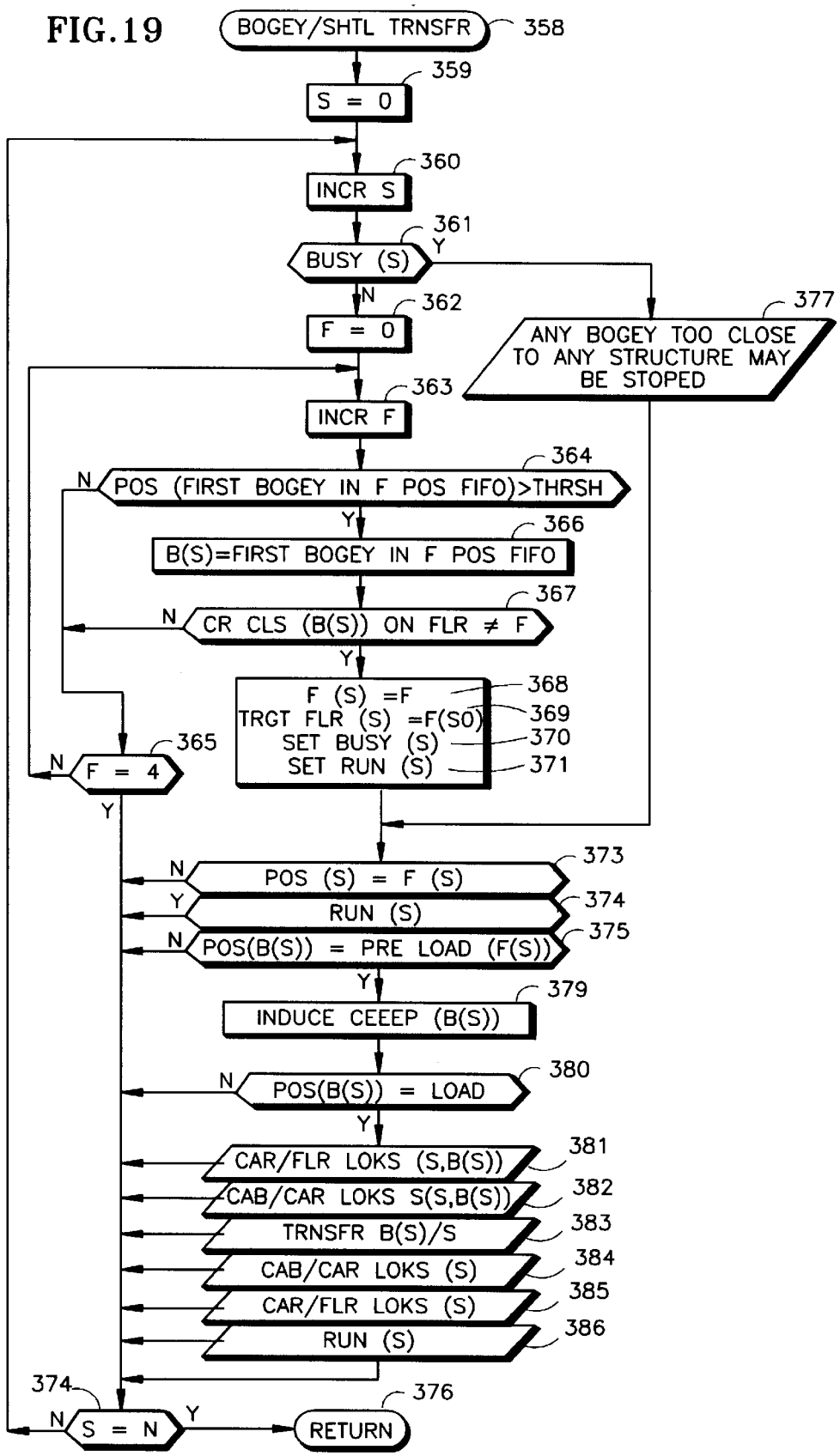
FIGS. 19 and 20 are simplified logic flow diagrams of exemplary routines which may be used in controlling transfers in the embodiments of FIGS. 15–18.

Referring to FIG. 19, a routine for transferring a cab from a bogey to a shuttle is reached through an entry point 358 and a first step 359 sets an S counter to zero. This is part of a scheme which, for each shuttle, determines if there is a nearby bogey that requires elevator service. Thus, the routine steps through each of the shuttles, and for each shuttle steps through all of the levels (herein referred to as floors, F) to determine if there is a bogey near the shuttle which needs service. A step 360 increments the S counter and then a test 361 determines if the particular shuttle being identified by the S counter is busy or not, in a manner described hereinafter. If the particular shuttle is busy, according to the test 361, this means that it has identified a bogey that needs service on one of the floors. Otherwise, it has not yet selected a bogey to service and a negative result of test 361 will reach a step 362 to set a floor counter, F, to zero. Then the floor counter is incremented in a step 363 to point to the first floor level of the building. A test 364 determines if the first bogey in a first in first out (FIFO) storage of bogey positions for floor F has a position which is greater than some threshold position value, indicative of the fact that it is approaching a shuttle where it may request to be moved from one floor level to another. If there is no such bogey on floor F, a negative result of test 364 reaches a test 365 to see if all of the four floors have been tested or not. If not, the routine reverts to the step 363 where the F counter is incremented and the test 364 again determines whether or not there is a bogey close to the shuttle. If there is, an affirmative result of test 364 will reach a step 366 to identify a selected bogey of the selected shuttle, B(S), as the first bogey in the position FIFO for floor F. Then a test 367 may determine whether there are any car calls on the selected bogey for a floor that is different from floor F. If not, the bogey needs no elevator service and a negative result of test 367 will pass through the test 365 and will revert to the step 363 unless all of the floors have been tested. Of course, if a bogey which is approaching an elevator has car calls on the same floor that it is on, turning or switching arrangements, not illustrated in FIGS. 15 and 16, need be provided to allow that bogey to continue to circulate on the same floor.

Assuming that the selected bogey has a car call on the floor other than its current floor, an affirmative result of test 367 will reach a sep 368 to identify the floor where S is to pick up the bogey as F(S). A step 369 sets the target floor for the selected shuttle to floor F so that the selected shuttle can go to floor F to pick up the cab from the selected bogey. A step 370 will set the busy S flag meaning this shuttle is busy (though others need not be), and a step 371 will set the selected shuttle, S, into the run condition. A test 373 then determines if the shuttle S has reached floor F; unless it is already located on that floor, initially it will not, so a negative result of test 373 will reach a test 374 to determine if the shuttle presently being considered is the highest numbered shuttle, N, in the system. If not, a negative result of test 374 will cause the program to revert to step 360 where the S counter is incremented.

For the next value of S, the selected shuttle may be busy or it may not; therefore, a process of determining if there is a bogey in the vicinity of this shuttle, which will need help in moving a cab vertically, will be repeated for this shuttle. On the other hand, this shuttle may be well along in the process (as described hereinafter), so if it is busy, an affirmative result of test 361 will cause the program to pass through a routine (or series of routines) 377 which may check the position of each bogey to ensure that none are too close to any structure for safety sake and stop such bogey. Then the test 373 is reached to determine if the presently designated shuttle is at its presently designated floor, F(S). If it is, then a test 374 determines if the selected shuttle is in the run condition. If so, test 374 is reverted to; but if not, then a test 375 determines if the position of the bogey identified in step 366 for this shuttle is in a preload position on the indicated floor, F(S). If it is not as yet, then another shuttle is dealt with, in the meantime, by passing through the test 374. Of course if this is the highest shuttle (N) in the system, then an affirmative result of test 374 could cause other programming to be reverted to through a return point 376.

In a subsequent pass through the routine of FIG. 19, for some shuttle working with a selected bogey on a selected floor, the bogey will be at the preload position on that floor for that shuttle. An affirmative result of test 375 will reach a step 379 to induce creep in the selected bogey, so that the selected bogey will slowly crawl into an overlap position indicated in FIGS. 17 and 18 whereby the cab can be rolled from the bogey into the shuttle. Then a test 380 determines if the current position of the selected bogey is the load position (that is the position shown in FIGS. 17 and 18). If not, the next shuttle in turn is dealt with through the test 374. But if so, an affirmative result of test 380 reaches a series of subroutines 381–386 which will first lock the car floor locks of the bogey and the car frame of the shuttle, and then unlock the cab car locks of the selected bogey so as to release the cab and unlock the cab car locks on the car frame so as to permit the cab to enter the car frame without interference. A subroutine 383 will cause transfer of the cab between the selected bogey and the shuttle, a subroutine 384 will lock the cab car locks on the car frame of the shuttle, a subroutine 385 will release the car floor locks of the shuttle car frame and a subroutine 386 will put the shuttle into the run condition. Then, the next shuttle in turn is dealt with through the test 374. The subroutines 381–386 are depicted as having exit points to the test 374 so that during the time that mechanical operations are being waited for, the programming is not held up. By keeping track of each bogey in each floor separately, the processing for one shuttle can be interleaved with the processing of another shuttle, as described.

Figure 20:
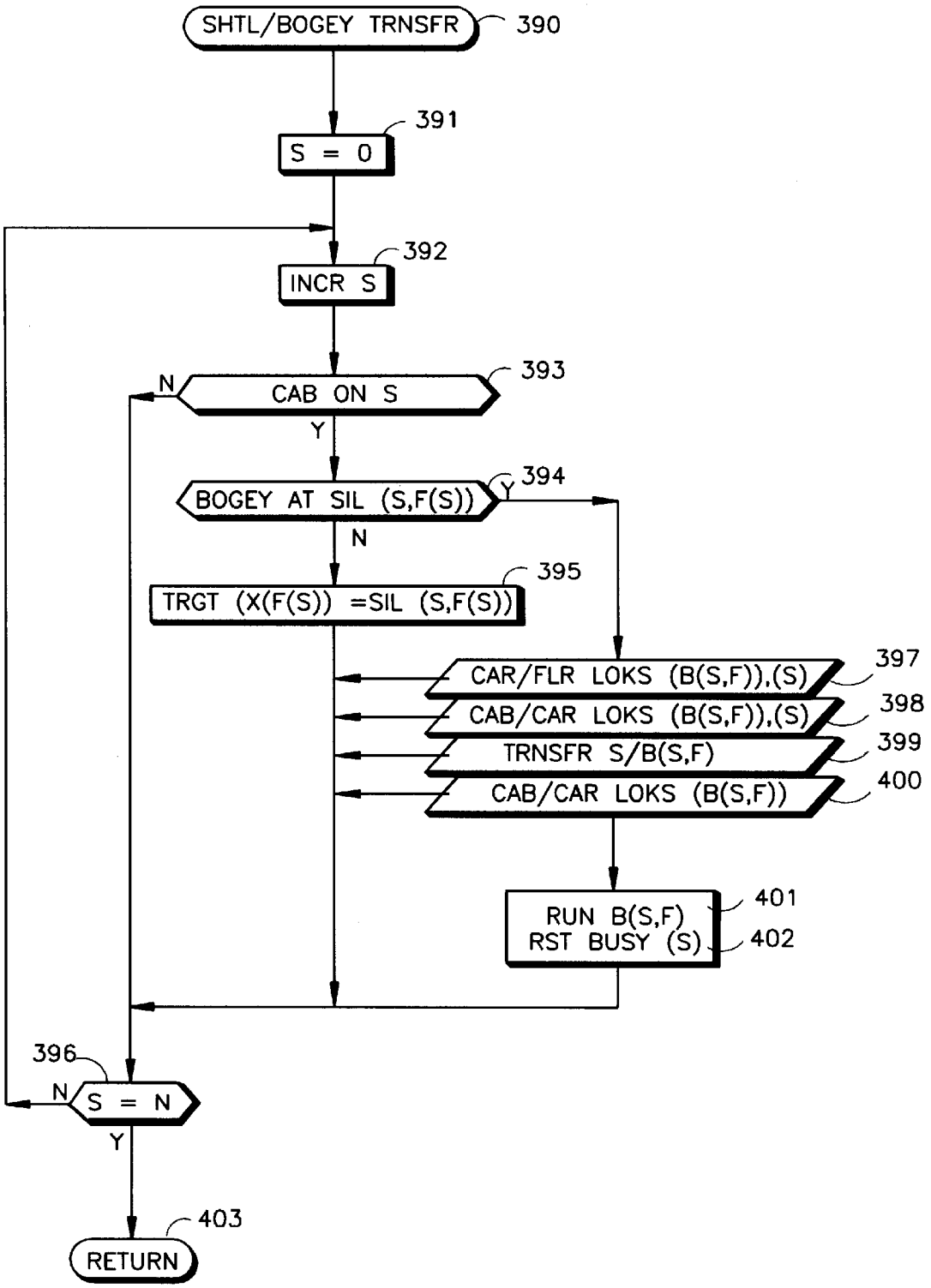

Referring to FIG. 20, a routine for transferring a cab from a shuttle to a bogey is reached through an entry point 390 and a first step 391 sets an S counter to zero. This is similar to the S counter set to zero in step 359 of FIG. 19. Then a step 392 increments the S counter and a test 393 determines if there is a cab on the selected shuttle. If not, the shuttle is dealt with, in turn, through a test 396. If there is a cab, a test 394 determines if there is a bogey at the sill of the shuttle designated by the S counter, on the target floor of the shuttle, F(S), as established in step 369 of FIG. 19. If not, a negative result of test 394 reaches a step 395 to set the target for an extra shuttle on the selected floor to the sill at the selected shuttle and floor. And then the next shuttle in turn may be dealt with.

In each pass through the routine of FIG. 20, any shuttle which has a cab will proceed through test 393 and 394 and when eventually there is a bogey at its sill on the target floor, then an affirmative result of test 394 will reach a subroutine 397 to lock the car floor locks of the bogey at the sill of the designated shuttle on the target floor and to lock the car floor locks of the shuttle. Then a subroutine 398 will cause the cab/car locks of both the car frame of shuttle S and the bogey at the sill thereof to become unlocked. A transfer subroutine 399 will move the cab from shuttle S to the bogey at the sill of shuttle S on the target floor. Then a subroutine 400 will lock the cab car locks on the bogey at the sill of the selected shuttle on the target floor, a step 401 will set the bogey into the run condition, to allow it to proceed to a landing indicated by a car call registered in the cab. A step 402 will reset the busy flag for shuttle S; this means that the shuttle can now be used to move some other cab. And then the test 396 determines if each shuttle in turn has been handled, or not, and if so, other programming is reverted to through a return point 403. The lock and transfer routines may be of the type described in the parent application and in the aforementioned application Ser. No. 08/663,869.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of moving passengers between a first point and a second point which is both vertically and horizontally remote from said first point, comprising:

moving passengers in a passenger cab on a carriage horizontally from said first point to a point adjacent to an elevator which is horizontally remote from said first point;

transferring said cab from said carriage onto a car frame of said elevator; and moving said cab on said elevator car frame vertically to the same vertical level as said second point.

2. A method according to claim 1 wherein said second point is horizontally remote from said elevator, said method further comprising:

transferring said cab from said elevator car frame to a second carriage disposed at the level of said second point; and moving said cab on said second carriage horizontally from said elevator to said second point.

3. A method according to claim 1 wherein said cab is transferred from said carriage to said car frame with motion which is in the same direction as the motion of said carriage to said elevator.

4. A method according to claim 1 wherein said cab is transferred from said carriage to said car frame with motion which is transverse to the motion of said carriage to said elevator.

5. A method of moving passengers between a first passenger landing at a first point on a first transport floor and a second passenger landing at a second point on a second transfer floor which is horizontally remote from said first point, which comprises:

moving a passenger cab on a first carriage to said first point on said first floor;

then loading a passenger into said cab at said first point;

then moving said cab on said first carriage horizontally on said first transport floor to a point horizontally remote from said first point on said first transport floor adjacent to the hatchway of an elevator;

then transferring said cab from said first carriage onto a car frame of said elevator; and then moving said cab on said car frame vertically from said first transport floor to said second transport floor.

6. A method of moving a passenger from a first point on a first transfer floor at a first level of a first building to a second point on a second transfer floor at a second level of a second building, comprising:

providing a passenger cab on a horizontally moveable first carriage at said first point;

allowing a passenger to board said cab at said first point;

transporting said cab on said first carriage horizontally between said first point and a hatchway on said first level of a first elevator that extends between said first level and a third level of said first building;

transferring said cab from said first carriage onto a first car frame of said first elevator;

moving said cab vertically on said first car frame from said first level of said building to said third level of said first building;

transferring said cab from said car frame of said first elevator to a second carriage disposed adjacent said first elevator on said third level;

moving said second carriage horizontally from said first building to said second building to a point adjacent to a hatchway of a second elevator which extends to said second level;

transferring said cab from said second carriage onto a second car frame of said second elevator; and moving said cab vertically on said second car frame to said second level.

7. A method of moving passengers between any of a plurality of mutually horizontally remote first passenger landings on a first transport floor to selected ones of a plurality of mutually horizontally remote second passenger landings on a second transport floor vertically remote from said first transport floor or a plurality of mutually horizontally remote third passenger landings on a third transport floor vertically remote from said first transport floor and vertically remote from said second transport floor, comprising:

moving a passenger cab on a first carriage horizontally past said plurality of first landings on said first transport floor;

stopping the carriage to allow passengers to enter the cab in response to a request therefor registered at any of said first landings;

moving said cab on said first carriage horizontally to a first elevator which extends between all of said floors;

transferring said passenger cab from said first carriage to a car frame in said elevator;

moving said cab vertically on said elevator car frame to a selected floor in the building, said selected floor being either said second transport floor or said third transport floor depending upon the registration in said cab of a request for service on said selected floor;

moving said cab from said elevator car frame onto a second carriage on said selected floor; and moving said cab horizontally on said second carriage to a passenger landing indicated by said request for service.

8. A method of moving passengers between any of a plurality of mutually horizontally remote first passenger landings on a first transport floor to selected ones of a plurality of mutually horizontally remote second passenger landings on a second transport floor vertically remote from said first transport floor or a plurality of mutually horizontally remote third passenger landings on a third transport floor vertically remote from said first transport floor and vertically remote from said second transport floor, comprising:

moving a passenger cab on a first carriage horizontally past said plurality of first landings on said first transport floor;

stopping the carriage to allow passengers to enter the cab in response to a request therefor registered at any of said first landings;

moving said cab on said first carriage horizontally to a first elevator which extends between said first transport floor and said second transport floor;

transferring said passenger cab from said first carriage to a car frame in said elevator;

moving said elevator cab vertically on said elevator car frame between said first transport floor and said second transport floor;

transferring said passenger cab from said elevator car frame to a second carriage adjacent said elevator on said second transport floor; and alternatively, either moving said elevator cab horizontally along a plurality of said second passenger landings on said second transport floor in response to a request registered in said cab for service to one of said second landings; or moving said passenger cab on said second carriage horizontally to a second elevator which extends between said second transport floor and said third transport floor and transferring said cab from said second carriage to a car frame of said second elevator, in response to a request registered for said cab for service to one of said third landings.

9. A system for providing horizontal and vertical transportation to passengers, comprising:

an elevator having a car frame vertically moveable therein;

a plurality of transport floors, each transport floor vertically remote from each other transport floor, each of said transport floors having a plurality of mutually horizontally remote passenger landings and a plurality of tracks adjacent said landings and extending between said elevator and said landings;

a plurality of carriages horizontally moveable on said tracks;

a plurality of passenger cabs moveable between said car frame and said carriages for horizontal movement on said transport floors and vertical movement in said elevator between said transport floors; and horizontal motive means for transferring said cabs between said elevator car frame and said carriages, whereby said cab is moved vertically on said elevator to and from said transport floors and horizontally on a carriage on selected ones of said transport floors.

10. A system according to claim 9 wherein said horizontal motive means transfers said cab between said car frame and said carriages with motion which is in the same direction as the motion of said carriages to said elevator.

11. A system according to claim 9 wherein said horizontal motive means transfers said cab between said car frame and said carriages with motion which is transverse to the motion of said carriages to said elevator.

12. A method according to claim 1 wherein said second point is adjacent said elevator, and further comprising:

allowing said passengers to exit from said cab on said car frame to said second point.

13. A method according to claim 5 wherein said second point is adjacent said elevator and additionally comprising allowing said passengers to exit said cab to said second point.

14. A method according to claim 5 wherein said second point is horizontally remote from said elevator, and further comprising:

transferring said cab from said elevator car frame to a second carriage which is adjacent to said elevator on said second transport floor; and then moving said cab on said second carriage horizontally on said second transport floor from said elevator to said second point.

15. A method according to claim 6 wherein said second point is adjacent said elevator and additionally comprising allowing said passengers to exit said cab to said second point.

16. A method according to claim 6 further comprising:

transferring said passenger cab from said second car frame onto a third carriage disposed on said second level adjacent to said second elevator; and moving said cab horizontally on said third carriage along said second level from said second elevator to said second point.

17. A method according to claim 16 further comprising:

allowing passengers to exit said cab from said car frame at said second point on said second level.

18. A method of moving passengers between a first passenger landing adjacent an elevator on a first floor and a second passenger landing at a point on a second floor which is horizontally remote from said elevator, which comprises:

providing a passenger cab on a car frame of said elevator at said first floor;

allowing passengers to board said cab at said first floor;

then moving said cab on said car frame vertically from said first floor to said second floor;

then transferring said cab from said elevator car frame to a carriage which is adjacent to said elevator on said second floor; and then moving said cab on said carriage horizontally on said second floor from said elevator to said point.

19. A method of moving a passenger from a first point on a first transfer floor at a first level of a first building to a second point on a second transfer floor at a second level of a second building, comprising:

providing a passenger cab on a first car frame at said first level of a first elevator that extends between said first level and a third level of said first building;

allowing passengers to board said cab on said first level;

moving said cab vertically on said first car frame from said first level to said third level of said first building;

transferring said cab from said car frame of said first elevator to a carriage disposed adjacent said first elevator on said third level;

moving said carriage horizontally from said first building to said second building to a point adjacent to a second elevator which extends to said second level in said second building;

transferring said cab from said carriage onto a second car frame of said second elevator; and moving said cab vertically on said second car frame in said second building to said second level.

20. A method according to claim 19 wherein said second landing is adjacent to said second elevator and further comprising:

allowing passengers to exit said cab from said car frame onto said second landing on said second level.

21. A method according to claim 19 wherein said second landing is remote from said second elevator and further comprising:

transferring said passenger cab from said second car frame onto a third carriage disposed on said second level adjacent to said second elevator;

moving said cab horizontally on said third carriage along said second level from said second elevator to said second landing; and allowing a passenger to exit said cab onto said second landing.

22. A system for providing horizontal and vertical transportation to passengers, comprising:

a plurality of elevators, each having a car frame vertically moveable therein, each disposed horizontally remote from another of said elevators, each elevator providing upward and downward service between a plurality of floors;

a track on one of said floors extending between one of said elevators and another of said elevators;

a carriage horizontally moveable on said track;

a plurality of passenger cabs moveable between said car frames and said carriage for horizontal movement between said elevators and vertical movement in said elevators; and horizontal motive means for transferring said cab between said elevator car frames and said carriage, whereby said cabs are moved vertically on said elevator and horizontally on said carriage between said elevators.

23. A system according to claim 22 wherein said horizontal motive means transfers said cab between said car frame and said carriages with motion which is in the same direction as the motion of said carriage to said elevator.

24. A system according to claim 22 wherein said horizontal motive means transfers said cabs between said car frame and said carriages with motion which is transverse to the motion of said carriage to said elevator.

25. A method of moving passengers between a first point and a second point which is horizontally remote from said first point, comprising the steps of:

(a) moving passengers in a passenger cab on a first car frame of an elevator vertically from said first point to a third point vertically remote from said first point;

(b) transferring said cab from said car frame onto a carriage adjacent to said elevator at said third point;

(c) moving said carriage horizontally from said third point to a fourth point horizontally remote from said third point adjacent to a second elevator;

(d) transferring said cab from said carriage onto a second car frame of said second elevator; and (e) moving said cab on said second car frame vertically to the same vertical level as said second point.

26. A method according to claim 25 further comprising, before said step (a), the step of:

allowing passengers to board said cab at said first point while said cab is on said first car frame.

27. A method according to claim 25 further comprising before said step (a), the steps of:

moving passengers in said cab on a second carriage to said first point from a fourth point horizontally remote from said first point; and transferring said cab from said second carriage to said first car frame.

28. A method according to claim 25 wherein said second point is adjacent said second elevator and further comprising, after said step (e):

allowing passengers to exit said cab at said second point.

29. A method according to claim 25 wherein said second point is horizontally remote from said second elevator and further comprising, after said step (e), the steps of:

transferring said cab from said second car frame onto a second carriage disposed adjacent said second elevator on the level of said second point; and moving said cab on said second carriage horizontally from said second elevator to said second point.

30. A method of moving passengers between a first passenger landing on a first transport floor to selected ones of a plurality of mutually horizontally remote second passenger landings on a second transport floor vertically remote from said first transport floor or, alternatively, to a plurality of mutually horizontally remote third passenger landings on a third transport floor vertically remote from said first transport floor and vertically remote from said second transport floor, comprising:

providing a passenger cab on a car frame of a first elevator which extends between all of said floors;

allowing passengers to enter said cab in response to a request therefor registered at said first landing;

moving said cab vertically on said elevator car frame to a selected floor in the building, said selected floor being either said second transport floor or said third transport floor depending upon the registration in said cab of a request for service on said selected floor;

moving said cab from said elevator car frame onto a carriage on said selected floor; and moving said cab horizontally on said carriage to a passenger landing indicated by said request for service.

31. A method of moving passengers between a first passenger landing on a first transport floor to selected ones of a plurality of mutually horizontally remote second passenger landings on a second transport floor vertically remote from said first transport floor or, alternatively, to a plurality of mutually horizontally remote third passenger landings on a third transport floor vertically remote from said first transport floor and vertically remote from said second transport floor, comprising:

providing a passenger cab on a car frame of a first elevator which extends between said first transport floor and said second transport floor;

allowing passengers to enter said cab in response to a request therefor registered at said first landing;

moving said elevator cab vertically on said elevator car frame between said first transport floor and said second transport floor;

transferring said passenger cab from said elevator car frame to a second carriage adjacent said elevator on said second transport floor; and alternatively, either moving said elevator cab horizontally along a plurality of said second passenger landings on said second transport floor in response to a request registered for said cab for service to one of said second landings; or moving said passenger cab on said second carriage horizontally to a second elevator which extends between said second transport floor and said third transport floor and transferring said cab from said second carriage to a car frame of said second elevator, in response to a request registered for said cab for service to one of said third landings.

* * * * *